US010834996B2

(12) United States Patent
James et al.

(10) Patent No.: US 10,834,996 B2
(45) Date of Patent: Nov. 17, 2020

(54) SOLE STRUCTURE WITH TRANSVERSELY MOVABLE COUPLER FOR SELECTABLE BENDING STIFFNESS

(71) Applicant: NIKE, Inc., Beaverton, OR (US)

(72) Inventors: Dervin A. James, Hillsboro, OR (US); Austin Orand, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 227 days.

(21) Appl. No.: 15/974,829

(22) Filed: May 9, 2018

(65) Prior Publication Data

US 2018/0343968 A1 Dec. 6, 2018

Related U.S. Application Data

(60) Provisional application No. 62/513,161, filed on May 31, 2017.

(51) Int. Cl.

| | |
|---|---|
| ***A43B 13/16*** | (2006.01) |
| ***A43B 13/14*** | (2006.01) |
| ***A43B 5/04*** | (2006.01) |
| *A43B 13/18* | (2006.01) |

(52) U.S. Cl.

CPC ..... *A43B 13/16* (2013.01); *A43B 5/0413* (2013.01); *A43B 5/0494* (2013.01); *A43B 13/14* (2013.01); *A43B 13/141* (2013.01); *A43B 13/181* (2013.01)

(58) Field of Classification Search

CPC ..... A43B 13/14

See application file for complete search history.

(56) References Cited

U.S. PATENT DOCUMENTS

| | | | | |
|---|---|---|---|---|
| 1,998,921 | A * | 4/1935 | Brown | A43B 5/18 36/7.7 |
| 5,243,776 | A | 9/1993 | Zelinko | |
| 5,343,636 | A * | 9/1994 | Sabol | A43B 5/18 36/27 |
| 6,226,901 | B1 * | 5/2001 | Rosen | A43B 7/1465 36/159 |
| 7,540,100 | B2 | 6/2009 | Pawlus et al. | |
| 7,549,239 | B2 * | 6/2009 | Drollinger | A43B 3/0042 36/127 |
| 7,631,382 | B2 | 12/2009 | DiBenedetto et al. | |

(Continued)

FOREIGN PATENT DOCUMENTS

| | | | |
|---|---|---|---|
| DE | 102007054763 | A1 | 5/2009 |
| DE | 102008020890 | A1 | 10/2009 |
| GB | 2414649 | A | 12/2005 |

*Primary Examiner* — Jila M Mohandesi
(74) *Attorney, Agent, or Firm* — Quinn IP Law

(57) ABSTRACT

A sole structure for an article of footwear comprises a first plate and a second plate both extending longitudinally in a flexion region of the sole structure. The second plate is disposed above the first plate in the flexion region. The second plate has a fixed portion fixed to the first plate, and has a free portion. A coupler is operatively connected to one of the first plate and the free portion of the second plate. The coupler is selectably movable transversely relative to the first plate and the second plate between a first position and a second position. The coupler is spaced apart from the other one of the first plate and the free portion of the second plate in the first position, and operatively engages the other one of the first plate and the free portion of the second plate in the second position.

14 Claims, 25 Drawing Sheets

(56) References Cited

U.S. PATENT DOCUMENTS

| | | | | |
|---|---|---|---|---|
| 8,646,191 | B2 * | 2/2014 | Amos | A43B 7/1425 36/103 |
| 9,155,353 | B2 | 10/2015 | James et al. | |
| 9,474,324 | B2 | 10/2016 | Smaldone et al. | |
| 9,491,983 | B2 | 11/2016 | Rushbrook | |
| 2007/0043630 | A1 | 2/2007 | Lyden | |
| 2011/0047816 | A1 | 3/2011 | Nurse | |
| 2013/0000154 | A1 | 1/2013 | Trinkaus | |
| 2014/0000125 | A1 * | 1/2014 | Butler | A43B 7/28 36/43 |
| 2016/0044992 | A1 | 2/2016 | Reinhardt et al. | |
| 2016/0249829 | A1 | 9/2016 | Trabia et al. | |
| 2017/0055626 | A1 * | 3/2017 | Rushbrook | A43B 13/12 |

* cited by examiner

SOLE STRUCTURE WITH TRANSVERSELY MOVABLE COUPLER FOR SELECTABLE BENDING STIFFNESS

CROSS-REFERENCE TO RELATED APPLICATIONS

This application claims the benefit of priority to U.S. Provisional Application No. 62/513,161 filed May 31, 2017, which is hereby incorporated by reference in its entirety.

TECHNICAL FIELD

The present teachings generally include a sole structure for an article of footwear, with the sole structure having a transversely movable coupler for adjusting a bending stiffness of the sole structure.

BACKGROUND

Footwear typically includes a sole structure configured to be located under a wearer's foot to space the foot away from the ground. Sole structures in athletic footwear are configured to provide desired cushioning, motion control, and resiliency.

DESCRIPTION

Figure 1:
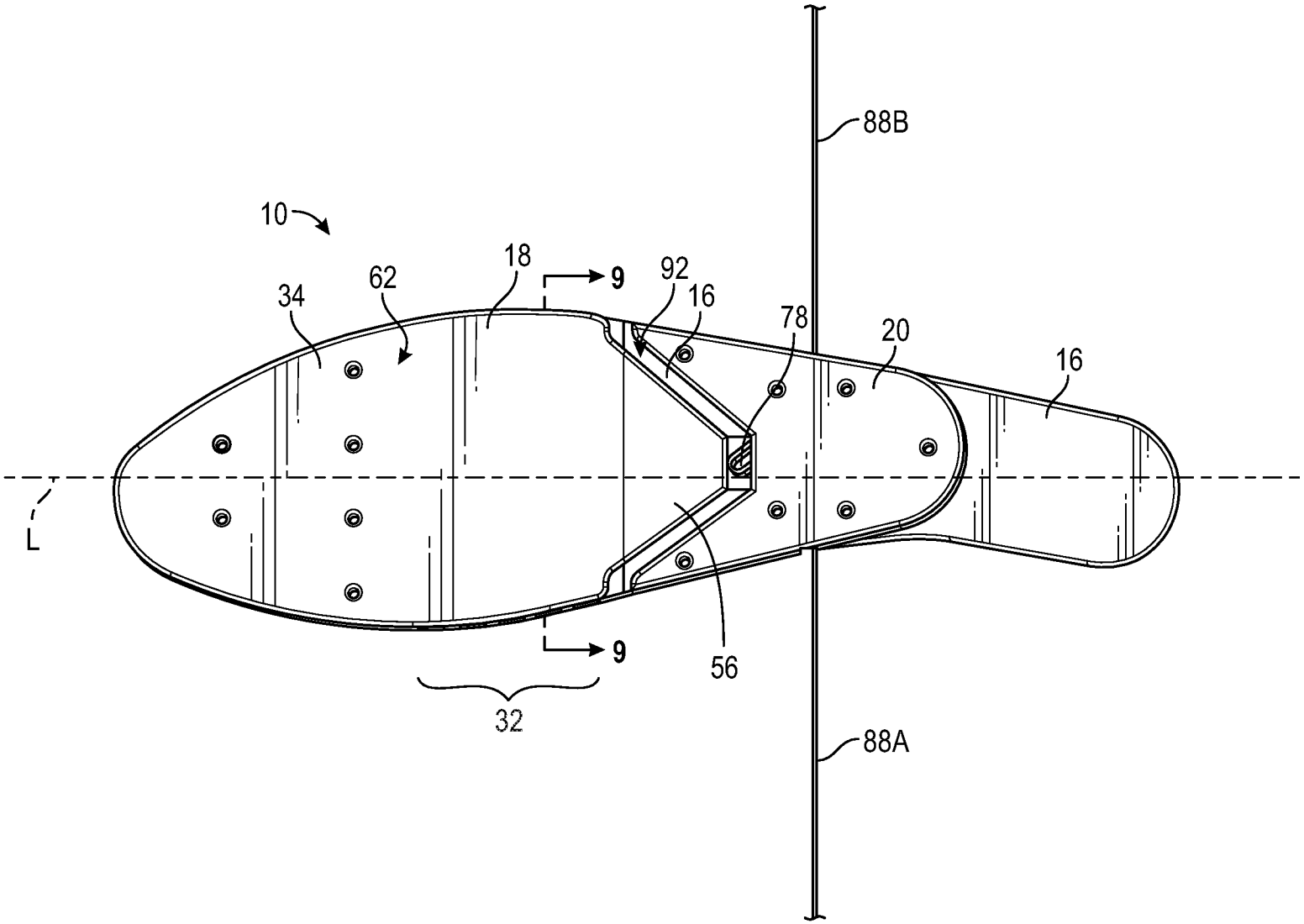
FIG. 1 is a plan view of a plate assembly of a sole structure of an article of footwear.

Some activities are best performed with a relatively stiff sole structure, while others are best performed with a less stiff (e.g., more flexible) sole structure. A sole structure disclosed herein can be selectively adjusted by a wearer between a relatively low bending stiffness and a relatively high bending stiffness as a user engages in different activities. The sole structure is configured so that the adjustment can be made while the user is wearing the article of footwear.

More particularly, a sole structure for an article of footwear comprises a first plate and a second plate. Both the first plate and the second plate extend longitudinally in a flexion region of the sole structure with the second plate disposed above the first plate in the flexion region. The second plate has a fixed portion fixed to the first plate, and has a free portion. A coupler is operatively connected to one of the first plate and the free portion of the second plate. The coupler is selectably movable transversely relative to the first plate and the second plate between a first position and a second position. The coupler is spaced apart from the other one of the first plate and the free portion of the second plate when the coupler is in the first position. The coupler operatively engages the other one of the first plate and the free portion of the second plate when the coupler is in the second position.

The plate assembly has a selectable binary stiffness because, with the coupler in the first position, the first plate and the second plate bend independently of one another, but when the coupler is in the second position, the first plate is operatively connected with the free portion of the second plate via the coupler, and the first plate and the second plate bend as a single unit. The bending stiffness of the plate assembly is greater when the coupler is in the second position, as a neutral bending axis of the plate assembly is between the first plate and the second plate, with the first plate bending in tension and the second plate bending in compression. Accordingly, a wearer of an article of footwear can selectively adjust the bending stiffness of a sole structure that includes the plate assembly by moving the coupler from the first position to the second position, or from the second position to the first position.

When the coupler is in the first position, the first plate has a portion in tension and a portion in compression during longitudinal bending of the sole structure at the flexion region. When the coupler is in the second position, the first plate is in tension and the second plate is in compression during longitudinal bending of the sole structure at the flexion region.

The second plate may be spaced apart from the first plate by a vertical gap in the flexion region. For example, the sole structure may further comprise stanchions extending from at least one of the first plate and the second plate across the vertical gap. The stanchions maintain the vertical gap between the first plate and the second plate during longitudinal bending of the sole structure in the flexion region.

In one or more embodiments, the stanchions include a medial set of stanchions extending adjacent a medial edge of the one of the first plate and the second plate to which the coupler is connected. The stanchions further include a lateral set of stanchions adjacent a lateral edge of the one of the first plate and the second plate to which the coupler is connected. The stanchions also include a central set of stanchions disposed between the medial set and the lateral set and extending from the other one of the first plate and the second plate than the medial set and the lateral set.

In one or more embodiments, each stanchion of the medial set and each stanchion of the lateral set has a groove at an inward side of the stanchion. Each stanchion of the central set has a medial lip at the medial side of the stanchion and a lateral lip at the lateral side of the stanchion. The medial lip interfits with the groove of the medial set and the lateral lip interfits with the groove of the lateral set.

In one or more embodiments, at the fixed portion of the second plate, a distal surface of the second plate has one of a protrusion and a recess. A proximal surface of the first plate has the other one of the protrusion and the recess. The protrusion fits into the recess. The recess may be an annular groove, and the protrusion may be an annular protrusion.

In one or more embodiments, a third plate is fixed to the first plate on the same side of the first plate as the second plate. The third plate is spaced longitudinally apart from the second plate by a longitudinal gap. The coupler is at least partially nested between the first plate and the third plate. The longitudinal gap exists at least during longitudinal bending of the sole structure over a flexion range, and the flexion range may be selected to be a greater range than is expected during use of the sole structure in a certain activity so that the longitudinal gap exists during the activity.

In one or more embodiments, the sole structure further comprises a midsole having a forefoot region, a midfoot region, and a heel region. The midsole overlies the first plate and the second plate. The midsole has an opening extending from a proximal surface of the midsole to a distal surface of the midsole in the forefoot region. The first plate and the second plate extend in the opening.

In one or more embodiments, the coupler is fixed to the first plate. The second plate has a protrusion with a wall at least partially facing the coupler. The coupler abuts the wall when the coupler is in the second position.

In one or more embodiments, the coupler includes a first link and a second link. The first link is pivotably connected to the first plate at a fixed pivot. The second link is pivotably connected to the first link at a movable pivot. The second link has a free end, and the movable pivot is disposed between the fixed pivot and the free end of the second link. The first link and the second link move transversely relative to the first plate at the movable pivot when the coupler moves from the first position to the second position. The free end of the second link is spaced apart from the free portion of the second plate when the coupler is in the first position, and operatively engages the second plate when the coupler is in the second position.

In one or more embodiments, at least one cable is secured to the coupler at the movable pivot. A medial portion of the at least one cable extends laterally-outward from the movable pivot beyond a medial edge of the first plate, and a lateral portion of the at least one cable extends laterally-outward from the movable pivot beyond a lateral edge of the first plate. The coupler is transversely movable from the first position to the second position by a laterally-outward force on one of the medial portion and the lateral portion of the at least one cable. The coupler is transversely movable from the second position to the first position by a laterally-outward force on the other of the medial portion and the lateral portion of the at least one cable.

The movable pivot may be transversely offset from both the fixed pivot and the free end of the second link toward one of the lateral edge and the medial edge of the first plate when the coupler is in the first position, and the movable pivot may be transversely offset from both the fixed pivot and the free end of the second link toward the other one of the lateral edge and the medial edge of the first plate when the coupler is in the second position.

In some embodiments, an upper may be secured to the sole structure. The medial portion of the at least one cable may extend along a medial side of the upper, and the lateral portion of the at least one cable may extend along a lateral side of the upper.

In one or more embodiments, a sleeve may surround either or both of the medial portion and the lateral portion of the at least one cable. For example, an elastic sleeve may overlay the exterior of the upper, and be liftable away from the upper when a force with a laterally-outward component is applied to the sleeve and the at least one cable therewithin, moving the coupler from the first position to the second position, or from the second position to the first position.

In one or more embodiments, the coupler has a medial end extending laterally-outward of a medial edge of the first plate in both the first position and the second position, and a lateral end extending laterally-outward of a lateral edge of the first plate in both the first position and the second position. The medial end and the lateral end may thus be easily accessible to a wearer of an article of footwear with a sole structure that includes the plate assembly, enabling a quick adjustment of bending stiffness when desired, with the article of footwear remaining on the wearer's foot.

In one or more embodiments, the coupler has a protrusion extending toward the other one of the first plate and the second plate, and the other one of the first plate and the second plate has a protrusion extending toward the coupler. For example, each of the protrusion. The protrusion of the coupler is transversely offset from and spaced apart from the protrusion of the other one of the first plate and the second plate when the coupler is in the first position. The protrusion of the coupler is at least partially aligned with and abuts the protrusion of the other one of the first plate and the second plate when the coupler is in the second position.

For example, the coupler may have a first set of teeth extending longitudinally toward the other one of the first plate and the second plate, and the other one of the first plate and the second plate may have a second set of teeth extending longitudinally toward the coupler. The protrusion of the coupler may be one of the teeth of the first set, and the protrusion of the other one of the first plate and the second plate may be one of the teeth of the second set. The teeth of the first set are transversely offset from and spaced apart from the teeth of the second set when the coupler is in the first position. The teeth of the first set of teeth are at least partially aligned with and abut the teeth of the second set when the coupler is in the second position.

In one or more embodiments, a post extends from the one of the first plate and the second plate. The coupler has a slot extending through the coupler from a proximal surface of the coupler to a distal surface of the coupler. The post extends through the slot of the coupler. The post is at a first end of the slot when the coupler is in the first position. The post is at a second end of the slot opposite the first end when the coupler is in the second position. The coupler may have a tab extending into the slot such that the slot is narrowed at the tab. The post may be between the first end of the slot and the tab when the coupler is in the first position, and the post may be between the second end of the slot and the tab when the coupler is in the second position.

In one or more embodiments, the sole structure further comprises a midsole at least partially surrounding the first plate and the second plate. The midsole has a medial side wall with a medial opening. The midsole has a lateral side wall with a lateral opening. The coupler extends through both of the medial opening and the lateral opening in both the first position and the second position.

The above features and advantages and other features and advantages of the present teachings are readily apparent from the following detailed description of the modes for carrying out the present teachings when taken in connection with the accompanying drawings.

Figure 10:
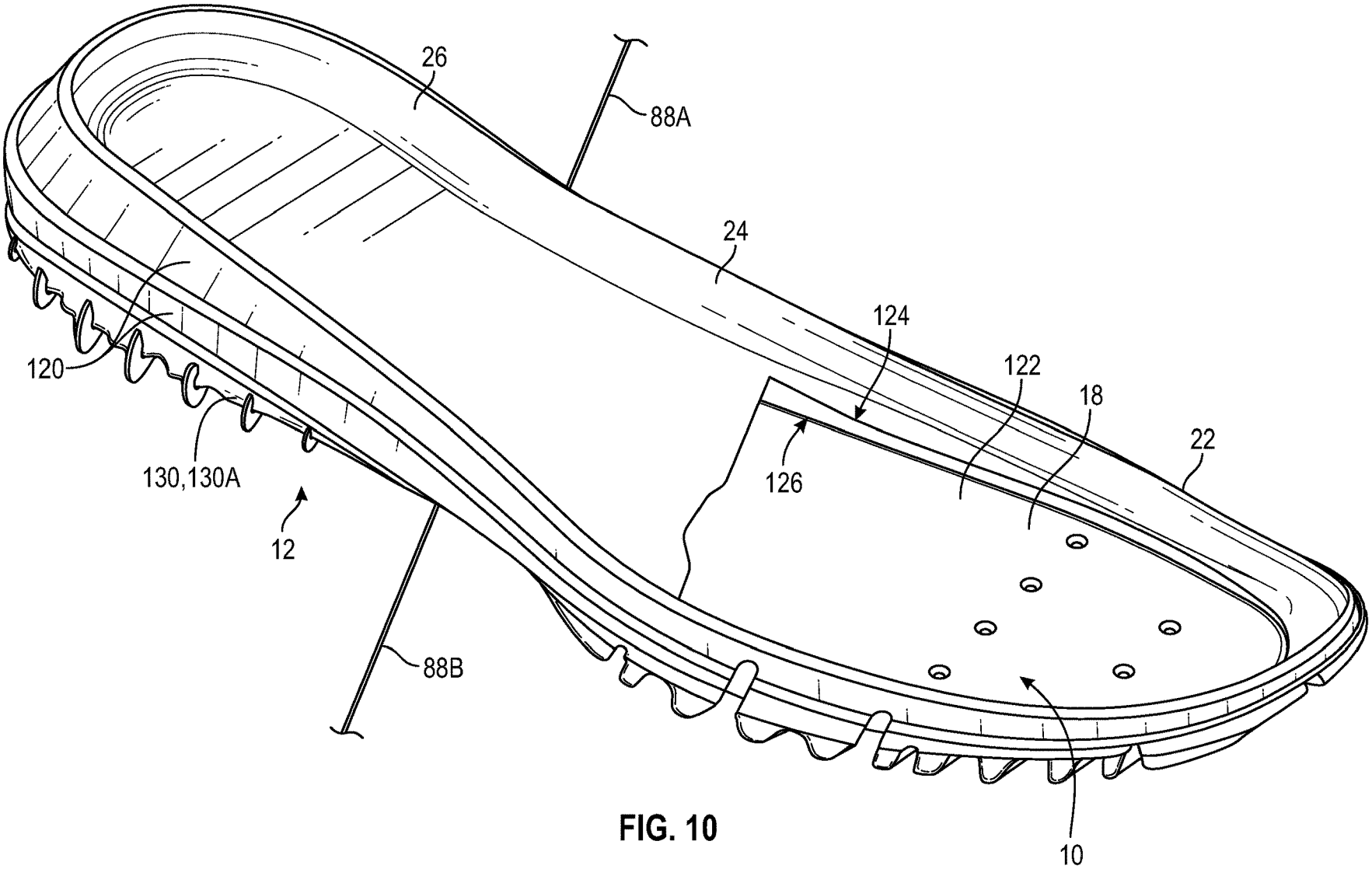
FIG. 10 is a lateral perspective view of a sole structure including a midsole, an outsole, and the plate assembly of FIG. 1.
Figure 12:
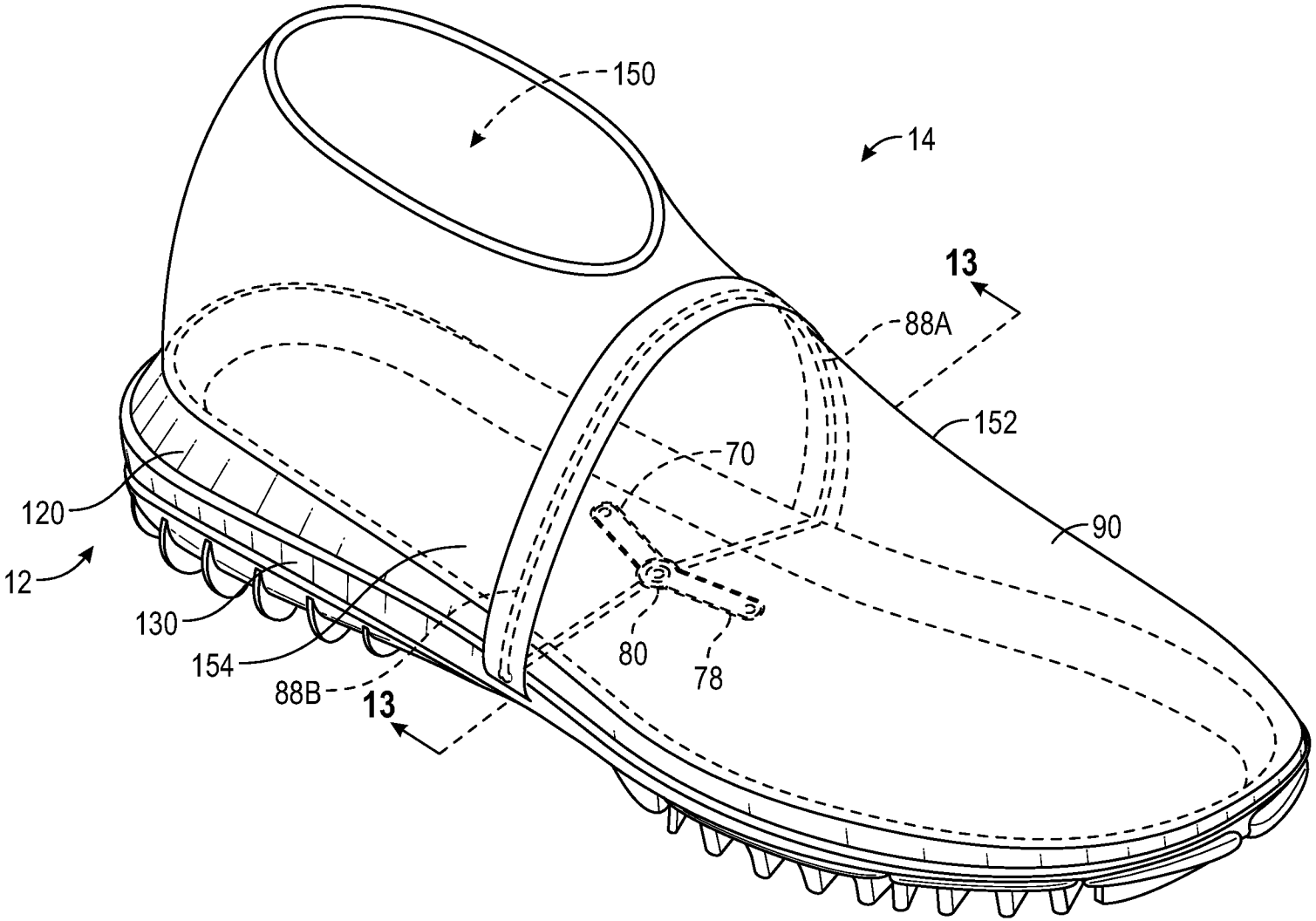
FIG. 12 is a lateral perspective view of an article of footwear including the sole structure of FIG. 10, an upper, and a cable connected to the coupler and extending around the upper.

Referring to the drawings, wherein like reference numbers refer to like components throughout the views, FIG. 1 is a plan view (i.e., a top view) of a plate assembly 10 of a sole structure for an article of footwear. A sole structure 12 including the plate assembly 10 is shown in FIG. 10, and an article of footwear 14 including the sole structure 12 is shown in FIG. 12. The plate assembly 10 is configured to provide a selectable binary stiffness, adjustable by the wearer while the article of footwear 14 is on the foot. Accordingly, a change from a relatively low level of stiffness to a relatively high level of stiffness can be quickly and easily made by the wearer. For example, the relatively low level of stiffness may be desirable for certain activities, such as walking, while the relatively high level of stiffness may be desirable for other activities such as when taking a golf swing.

With reference to FIG. 1, the plate assembly 10 includes a first plate 16, a second plate 18, and a third plate 20. As used herein, the term "plate" refers to a member of a sole structure that is generally horizontally disposed when assembled in an article of footwear that is resting on the sole structure on a level ground surface, and is generally used to provide structure and form rather than cushioning. A plate need not be a single component but instead can be multiple interconnected components. Portions of a plate can be flat, and portions can be pre-formed with some amount of curvature and variations in thickness when molded or otherwise formed in order to provide a shaped footbed and/or increased thickness for reinforcement in desired areas. For example, in the plate assembly 10, each of the first plate 16, the second plate 18, and the third plate 20 are discrete components. However, the first plate 16, the second plate 18 and/or the third plate 20 could be integral portions of a single, unitary component, similar to the embodiment of FIGS. 25-27, such as if the first plate 16, second plate 18, and third plate 20 are three-dimensionally printed as a single component.

The first plate 16 has a forefoot region 22, a midfoot region 24, and a heel region 26. The forefoot region 22, midfoot region 24, and heel region 26 correspond to and may be used to refer to like regions of the sole structure 12 and the article of footwear 14 and of any of the components thereof. The forefoot region 22 generally includes portions of the first plate 16 corresponding with the toes and the joints connecting the metatarsals with the phalanges of the human foot (interchangeably referred to herein as the "metatarsal-phalangeal joints" or "MPJ" joints). The midfoot region 24 generally includes portions of the first plate 16 corresponding with an arch area of the human foot, including the navicular joint. The heel region 26 generally includes portions of the first plate 16 corresponding with rear portions of a human foot, including the calcaneus bone, when the human foot is supported on the sole structure and is a size corresponding with the sole structure. The forefoot region 22, the midfoot region 24, and the heel region 26 may also be referred to as a forefoot portion, a midfoot portion, and a heel portion, respectively, and may also be used to refer to corresponding regions of an upper and other components of an article of footwear. The midfoot region 24 is disposed between the forefoot region 22 and the heel region 26, such that the forefoot region 22 is forward of (i.e., anterior to) the midfoot region 24 and the heel region 26 is rearward of (i.e., posterior to) the midfoot region 24.

Figure 3:
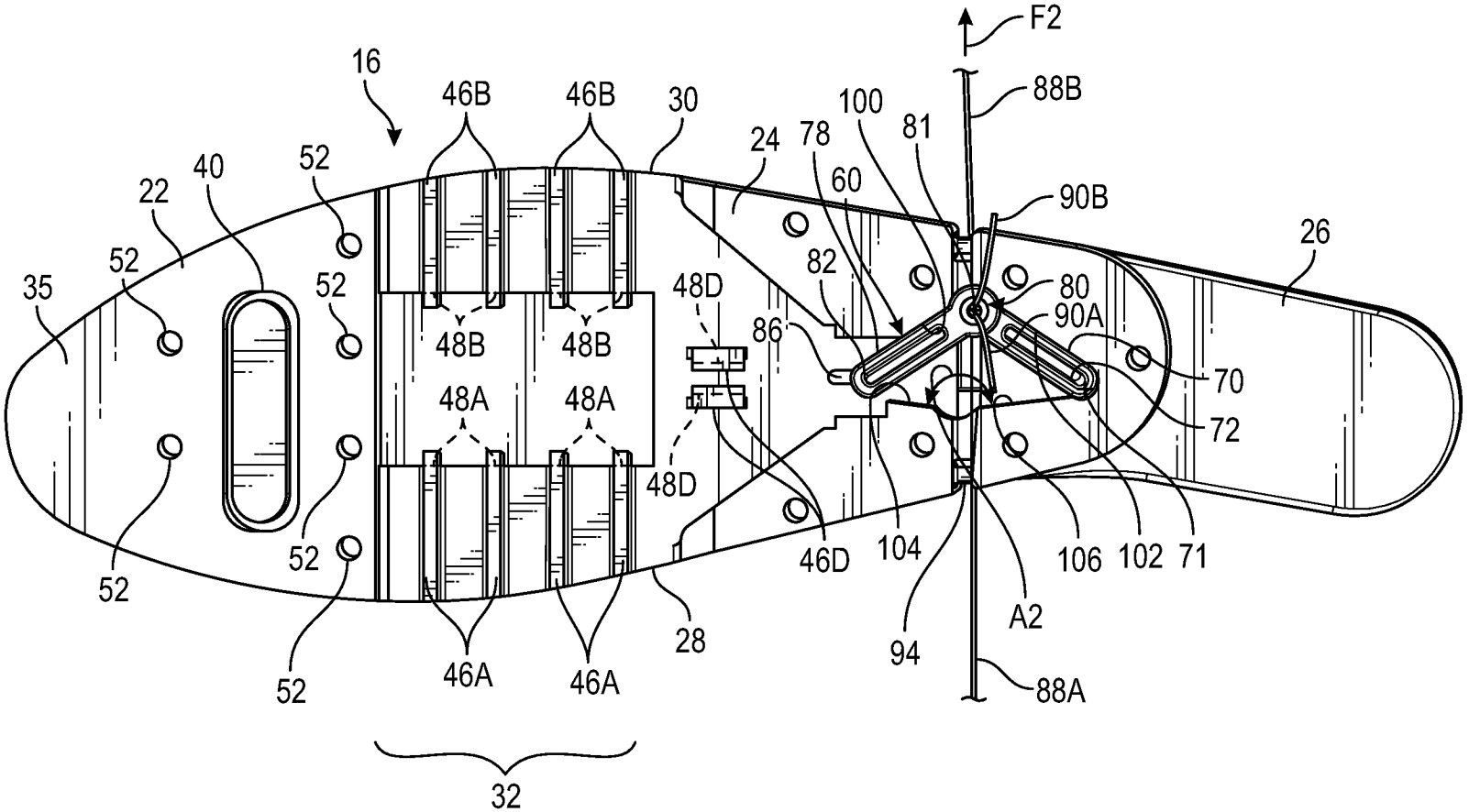
FIG. 3 is a plan view of the first plate and the coupler of FIG. 2 with the coupler in a first position.

The first plate 16 has a medial edge 28 and a lateral edge 30, as best shown in FIG. 3. The medial edge 28 and the lateral edge 30 extend along the forefoot region 22, the midfoot region 24, and the heel region 26. The plate assembly 10 is for a right foot. It should be understood that a plate assembly for a left foot is a mirror image of the plate assembly 10.

Both the first plate 16 and the second plate 18 extend longitudinally in a flexion region 32 of the sole structure. The plate assembly 10 has a longitudinal axis L, and both plates 16, 18 extend along the longitudinal axis L. The second plate 18 is disposed above the first plate 16 in the flexion region 32. The flexion region 32 is generally the region that corresponds to the metatarsal phalangeal joints (MPJ joints) of the foot. Accordingly, during dorsiflexion, the flexion region 32 flexes along the longitudinal axis L.

The second plate 18 has a fixed portion 34 fixed to the first plate 16. More particularly, the fixed portion 34 is the portion of the second plate 18 that is anterior to the flexion region 32. The fixed portion 34 is aligned with and then secured to a first portion 35 (see FIG. 3) of the first plate 16 forward of the flexion region 32. The fixed portion 34 can be aligned with the first portion 35 such as by fitting an annular protrusion 36 that extends from a distal surface 38 of the second plate 18 (see FIG. 5) into an annular recess 40 in a proximal surface 42 of the first plate 16 (see FIG. 3). The annular protrusion 36 and the annular recess 40 may be configured to provide an interference fit, so that the fixed portion 34 is secured to the first portion 35 via the interfitting protrusion 36 and recess 40. Alternatively, the annular protrusion 36 may extend from the first plate 16, and the annular recess 40 may be in the second plate 18. The annular protrusion 36 and the annular recess 40 are elongated ovals that extend longitudinally and also extend transversely over more than half of the width of the first portion 35, which helps to prevent any rotational displacement of the second plate 18 relative to the first plate 16 at the annular protrusion 36. Alternatively, the annular protrusion 36 and the annular recess 40 may have other shapes that are not annular.

The second plate 18 is positioned over the first plate 16 via interfitting stanchions that extend in a vertical gap 44 (see FIGS. 8A-8C) that exists between the first plate 16 and the second plate 18 in the flexion region 32. The plate assembly 10 is configured so that the vertical gap 44 is uniform in height over the flexion region 32, or is at least sufficiently uniform such that the distal surface 38 of the second plate 18 is spaced apart from and does not come into contact with the proximal surface 42 of the first plate 16 during longitudinal bending in the flexion region 32. Ensuring that the vertical gap 44 remains during longitudinal bending of the plate assembly 10 enables the bending stiffness of the plate assembly 10 to be controlled by the position of the coupler 60 described herein.

Stanchions 46A and 46B extend from the proximal surface 42 of the first plate 16 across the vertical gap 44, and stanchions 46C extend from the distal surface 38 of the second plate 18 across the vertical gap 44 to help maintain the uniform vertical gap 44. More specifically, a medial set of stanchions 46A extends adjacent the medial edge 28 of the first plate 16, and a lateral set of stanchions 46B extend adjacent the lateral edge 30 of the first plate 16 as shown in FIG. 3. A central set of stanchions 46C extends from the second plate 18 and is disposed between the medial set 46A and the lateral set 46B in the assembled plate assembly 10. Alternatively, the medial set 46A and the lateral set 46B may extend from the distal surface 38 of the second plate 18, and the central set 46C may extend from the proximal surface 42 of the first plate 16. The stanchions 46A, 46B, 46C help to prevent buckling of the second plate 18 when the second plate 18 is under longitudinal compression during longitudinal bending as described herein.

Figure 5:
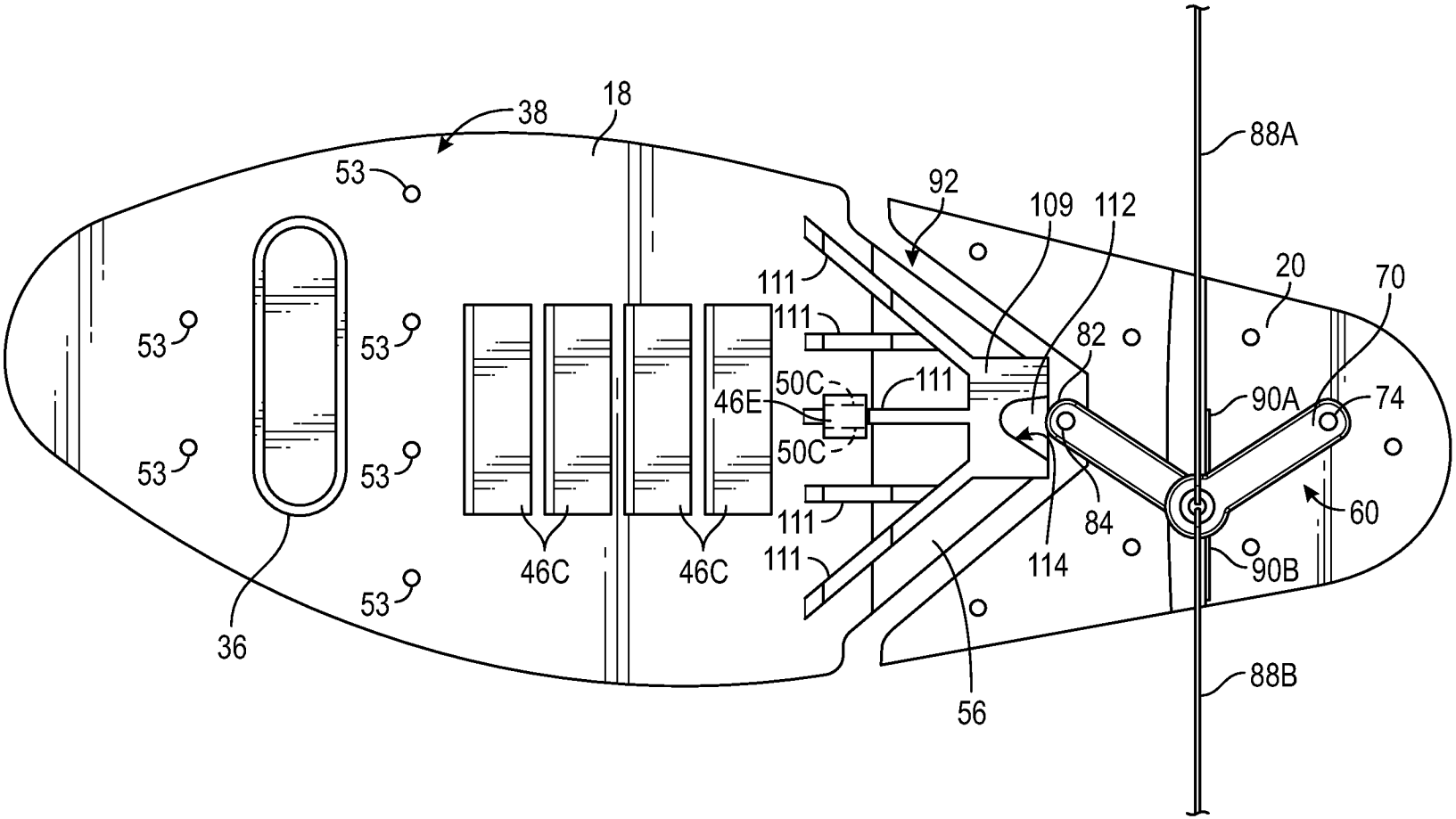
FIG. 5 is a bottom view of a second plate, the coupler, and a third plate of the plate assembly of FIG. 1 with the coupler in the first position.
Figure 9:
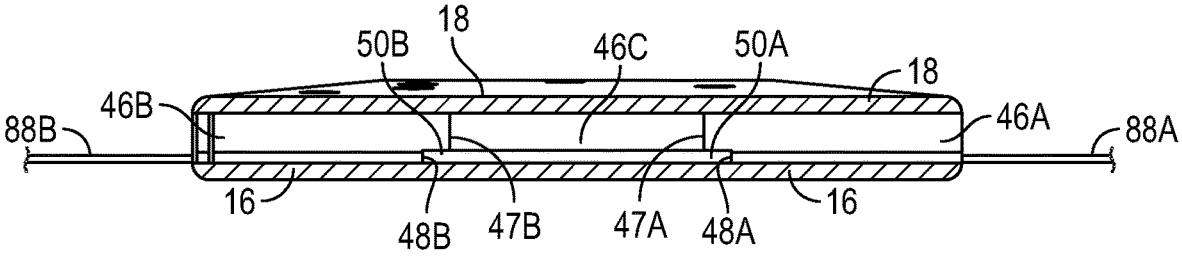
FIG. 9 is a cross-sectional view of the plate assembly of FIG. 1 taken at lines 9-9 in FIG. 1.

The stanchions in each respective set 46A, 46B, 46C are spaced longitudinally apart from one another, and are transversely aligned with the stanchions of the other sets. The stanchions 46C interfit with the stanchions 46A, 46B to further position the second plate 18 relative to the first plate 16 in the flexion region 32. More specifically, as best shown in FIG. 9, each stanchion of the medial set 46A has a groove 48A at a laterally-inward side of the stanchion, and each stanchion of the lateral set 46B has a groove 48B at a laterally-inward side of the stanchion. Each stanchion of the central set 46C has a medial lip 50A at the medial side of the stanchion and a lateral lip 50B at the lateral side of the stanchion. The medial lip 50A interfits with the groove 48A of the medial set 46A and the lateral lip 50B interfits with the groove 48B of the lateral set 46B. As best shown in FIG. 9, the grooves 48A, 48B and the transverse width of the stanchions 46C as well as the height of the stanchions 46C are such that transverse gaps 47A exist between the stanchions 46C and the stanchions 46A and 46B, and a vertical gap 47B exists between the stanchions 46C and the proximal surface of the first plate 16. This enables some longitudinal movement of the second plate 18 relative to the first plate 16 in the flexion region 32 during longitudinal bending of the plate assembly 10 when the coupler 60 is in the first position. As best shown in FIGS. 3 and 5, a pair of stanchions 46D extending from the first plate 16 interfit with a stanchion 46D extending from the second plate 18 with lips 50C of the stanchion 46E fitting in grooves 48D of the stanchions 46D. The grooves 48D and lips 50C as well as the height of the stanchion 46D are such that transverse gaps exist between the stanchions 46D and the stanchion E, and a vertical gap exists between the stanchion 46E and the proximal surface of the first plate 16 to enable some longitudinal movement of the second plate 18 relative to the first plate 16 in the flexion region 32 during longitudinal bending of the plate assembly 10 when the coupler 60 is in the first position.

When the recess 40 and protrusion 36 are interfit, the lips 50A, 50B of the stanchions 46C are interfit to the grooves 48A, 48B of the stanchions 46A, 46B, and the lips 50C of stanchion 46E are interfit with grooves 48D of stanchions 46D, the second plate 18 is properly positioned over the first plate 16. In this position, through-holes 52 of the first plate 16 (see FIG. 3) align with through-holes 53 of the second plate 18 (see FIG. 5). Rivets, adhesive, or other securement modes may be used at the aligned through-holes to fix the fixed portion 34 of the second plate 18 to the first plate 16.

Figure 8A:
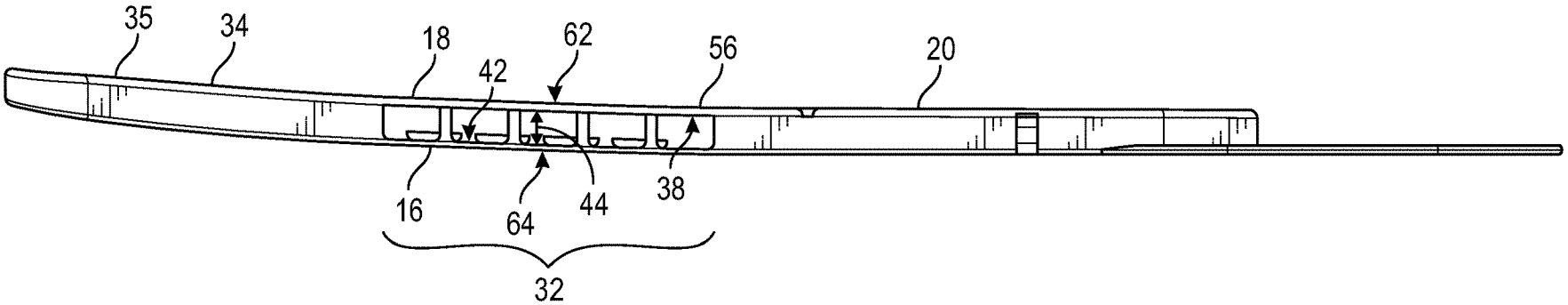
FIG. 8A is a medial side view of the plate assembly of FIG. 1.

With reference to FIGS. 1 and 8A, the second plate 18 has a free portion 56 that is disposed rearward of the flexion region 32 when the fixed portion 34 of the second plate 18 is fixed to the first portion 35 of the first plate 16. The free portion 56 is referred to as "free" because it is not fixed relative to an underlying portion of the first plate 16 when the coupler 60 is in a first position. As further disclosed herein, this allows the first plate 16 and the second plate 18 to bend each with its own neutral bending axis 66A, 66B respectively (shown in FIG. 8B) during longitudinal bending of the plate assembly 10 when not operatively connected by the coupler 60. When the coupler 60 is moved to the second position and operatively engages the second plate 18, however, the free portion 56 is longitudinally fixed relative to the underlying portion of the first plate 16, and the plate assembly 10 bends as a single unit with a single neutral bending axis 66C (shown in FIG. 8C) and a significantly greater bending stiffness.

Figure 4:
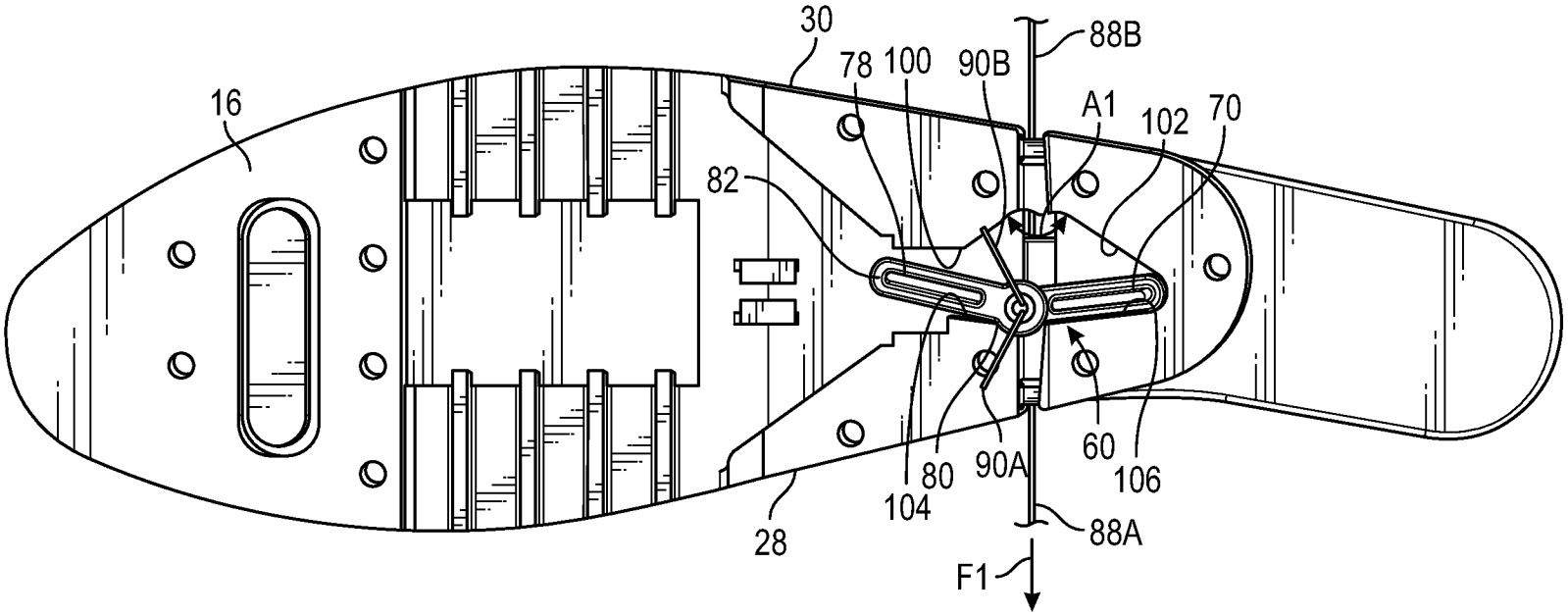
FIG. 4 is a plan view of the first plate and the coupler of FIG. 3 with the coupler in a second position.
Figure 6:
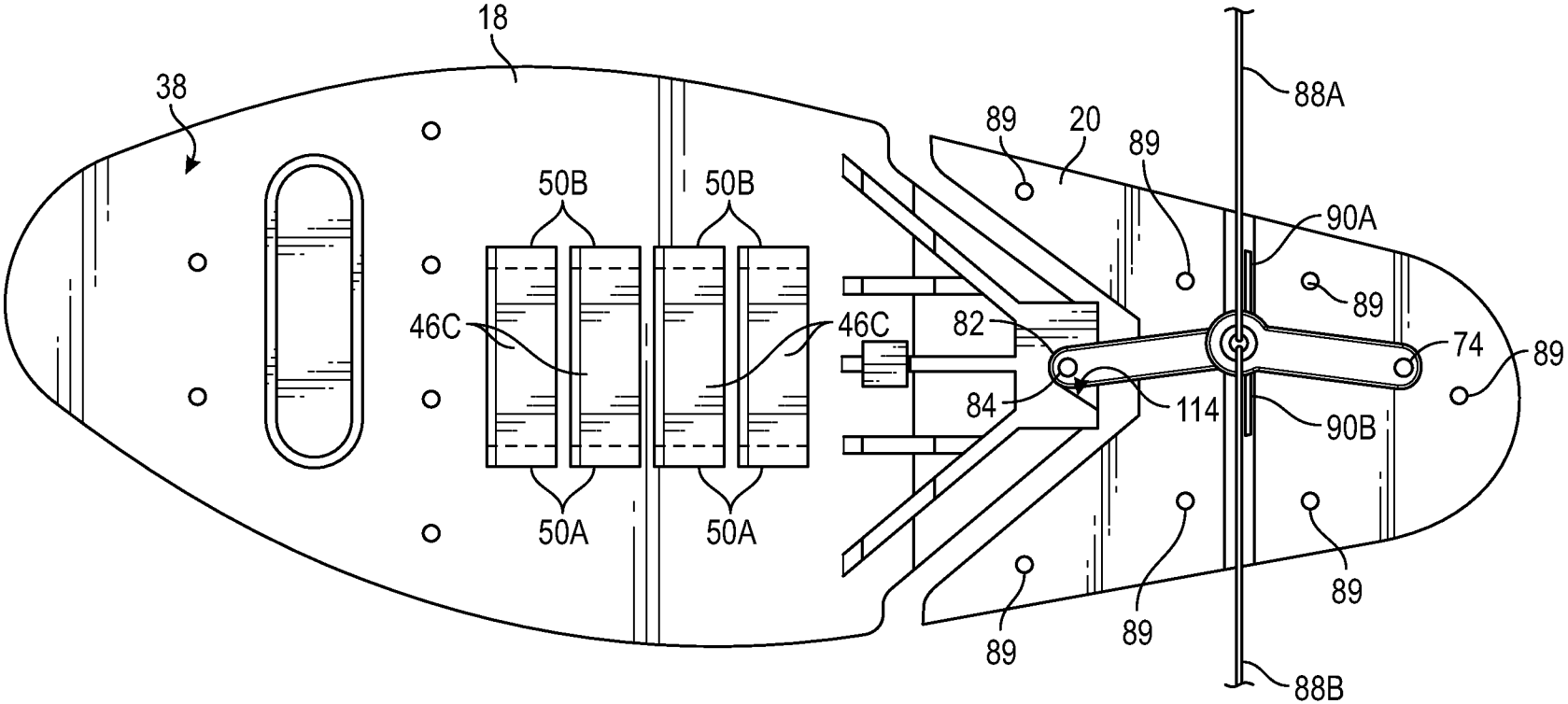
FIG. 6 is a bottom view of the second plate, the coupler, and the third plate of the plate assembly of FIG. 5 with the coupler in the second position.
Figure 8B:
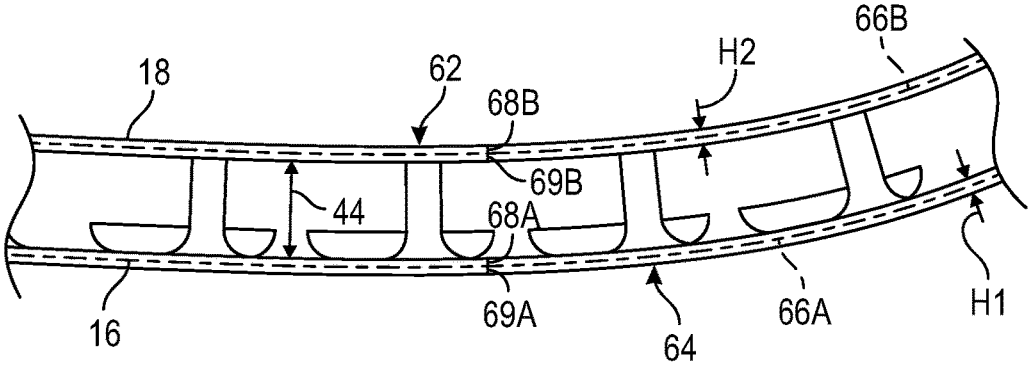
FIG. 8B is a fragmentary medial side view of the plate assembly of FIG. 1 representing dorsiflexion with the coupler in the first position.

Referring to FIG. 3, a transversely movable coupler 60 is selectively movable between a first position of FIGS. 3 and 5 and a second position of FIGS. 4 and 6. In the first position, when the plate assembly 10 bends along the longitudinal axis L at the flexion region 32, each plate 16, 18 bends independently of one another, and the bending stiffness of the plate assembly 10 in the flexion region 32 is associated with the sum of the bending stiffness of the first plate 16 and the bending stiffness of the second plate 18. Stated differently, a neutral bending axis 66A extends through the first plate 16 and a separate neutral bending axis 66B extends through the second plate 18, as shown in FIG. 8B, when the coupler 60 is in the first position. A portion 68A of the first plate 16 above the neutral axis 66A is subject to compression and a portion 69A of the first plate 16 below the neutral axis 66A is subject to tension during longitudinal bending of the plate assembly 10 along the longitudinal axis L at the flexion region 32 when the coupler 60 is in the first position. A portion 68B of the second plate 18 above the neutral axis 66B is subject to compression and a portion 69B of the second plate 18 below the neutral axis 66B is subject to tension during longitudinal bending of the plate assembly 10 along the longitudinal axis L at the flexion region 32 when the coupler 60 is in the first position.

With the coupler 60 in the first position, the bending stiffness of each plate 16, 18 is proportional to its moment of inertia about the fixed portions 34, 35. Generally, the longitudinal bending stiffness of a plate is directly proportional to the moment of inertia (I) of the plate, with bending stiffness increasing linearly as moment of inertia increases. Equation 1 is the moment of inertia/of a plate:

$$I = \left(\frac{4bh^3}{12}\right), \quad \text{Equation 1}$$

where b is the width of the plate, and h is the height of the plate. Accordingly, the bending stiffness of a plate is proportional to the cube of its height.

When the coupler 60 is in the first position, the bending stiffness of the plate assembly 10 is associated with the height H1 of the first plate 16, and the height H2 of the second plate 18 in the flexion region 32. The height of the stanchions extending from the plates 16, 18 do not influence the bending stiffness as they are not fixed to the neighboring plate.

When the coupler 60 effectively couples the second plate 18 to the first plate 16 when in the second position so that the stiffness of the plate assembly 10 is correlated with the overall height H3 of the plate assembly 10 from the proximal surface 62 of the second plate 18 to the distal surface 64 of the first plate 16. When the coupler 60 is in the second position, the first plate 16 is in tension and the second plate 18 is in compression during longitudinal bending of the plate assembly 10 at the flexion region 32 over the flexion range.

Figure 7:
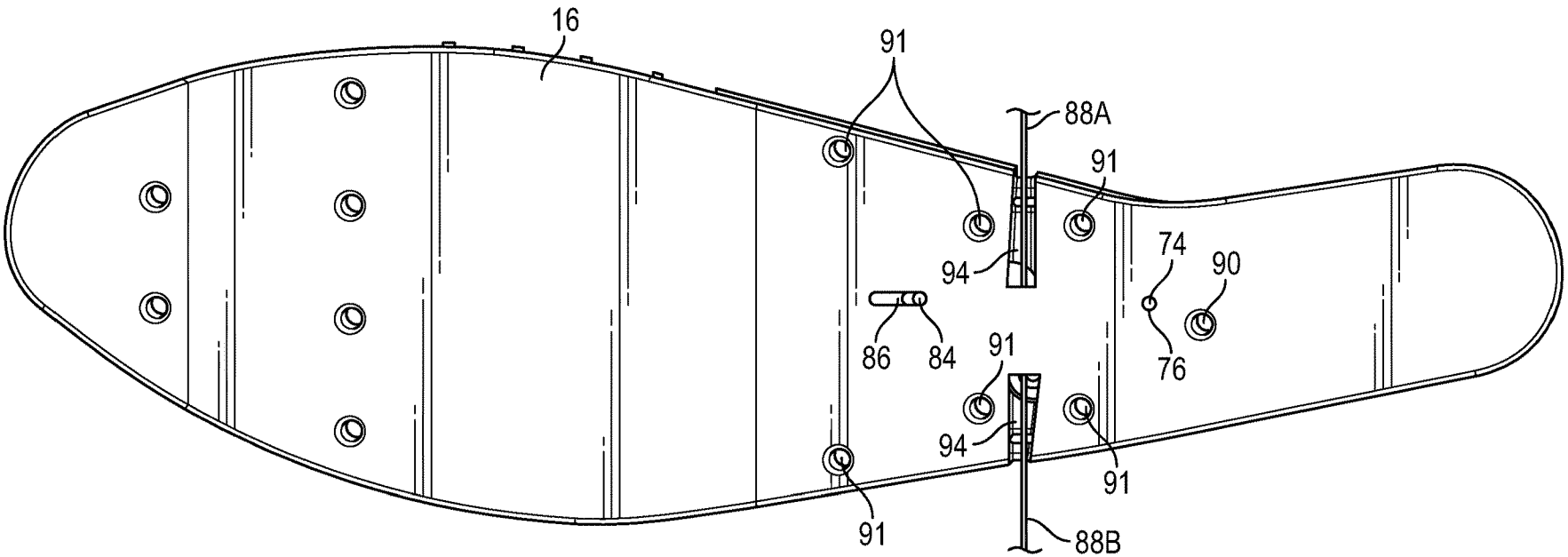
FIG. 7 is a bottom view of the first plate of the plate assembly of FIG. 1 and partially showing the coupler in the first position.
Figure 16:
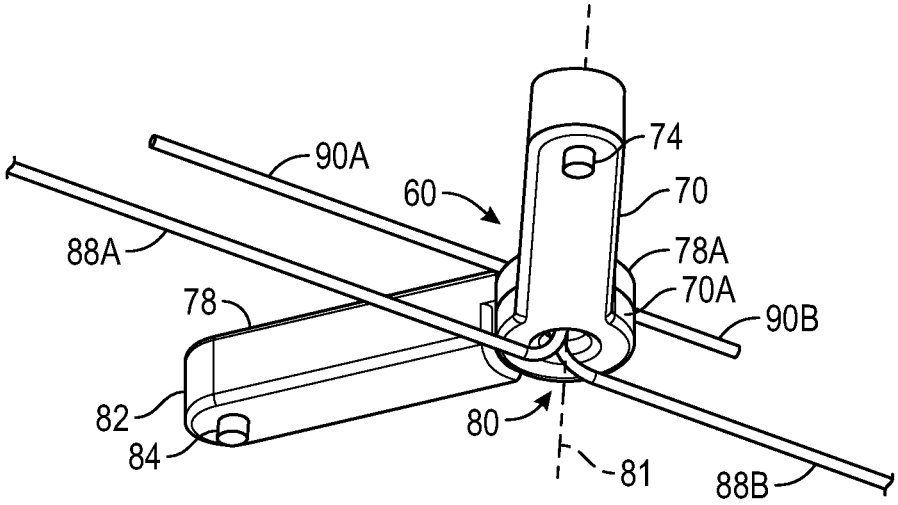
FIG. 16 is a schematic perspective view of a coupler of the plate assembly of FIG. 1.

The coupler 60 is operatively connected to the first plate 16 and is disposed adjacent to the free portion 56 of the second plate 18. As best shown in FIG. 3, the coupler 60 includes a first link 70 and a second link 78. The first link 70 has a fixed end 71 pivotably connected to the first plate 16 at a fixed pivot 72, best shown in FIGS. 3 and 7. For example, a pin 74 extends downward from the link 70 into an opening 76 of the first plate 16, establishing a fixed pivot axis, also referred to as a fixed pivot 72 as best shown in FIGS. 5, 7, and 16.

Figure 17:
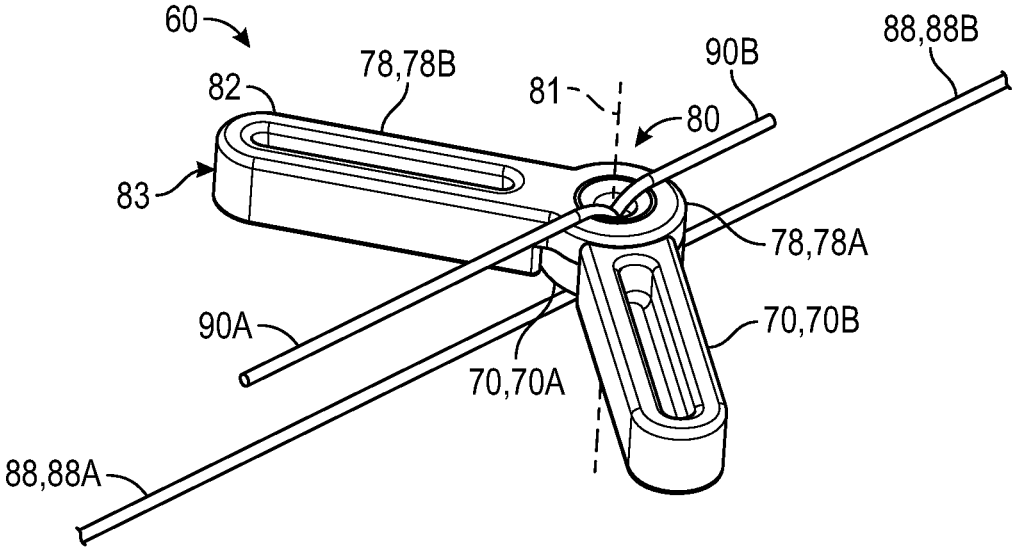
FIG. 17 is another schematic perspective view of the coupler of FIG. 16.

The second link 78 is pivotably connected to the first link 70 at a movable pivot 80. For example, as shown in FIGS. 16 and 17, an end 70A of the first link 70 is a circular head with a central opening. The circular head of the end 70A is approximately one half the height of the body 70B of the link 70. The second link 78 also has an end 78A with a circular head having a central opening, with the circular head of the end 78A approximately half the height of the body 78B of the second link 78. The ends 70A, 78A heads are stacked on one another with the openings aligned, defining a movable pivot with a pivot axis 81.

The second link 78 also has a free end 82. The free end 82 has a pin 84 extending from its distal surface. The pin 84 is received in a slot 86 that extends through the first plate 16 as best shown in FIGS. 3 and 7. The free end 82 is referred to as "free" because its longitudinal position relative to the first plate 16 can vary along the length of the slot 86 as the pin 84 rides in the slot 86. In contrast, the fixed end 71 is fixed in a longitudinal position relative to the first plate 16 at the fixed pivot 72. The movable pivot 80 is between the fixed pivot 72 and the free end 82 of the second link 78 in the longitudinal direction, both when the coupler 60 is in the first position and when the coupler 60 is in the second position as shown in FIGS. 3 and 4.

The plate assembly 10 includes a third plate 20 disposed above and fixed to the first plate 16 on the same side of the first plate 16 as the second plate 18 (i.e., on the proximal side in FIG. 1). For example, through-holes 89 of the third plate 20 (shown in FIG. 6) align with through-holes 91 of the first plate 16 (shown in FIG. 7), and rivets, adhesive, or other connecting modes may be used to join the third plate 20 to the first plate 16 at the aligned through-holes. The coupler 60 is at least partially nested between the first plate 16 and the third plate 20. The third plate 20 is spaced longitudinally apart from the free portion 56 of the second plate 18 at a longitudinal gap 92. The width of the longitudinal gap 92 is selected so that the gap 92 remains open over a flexion range that is at least as great as the range of flexion expected during various activities. For example, the gap 92 is configured to remain open over a range of flexion of 45 degrees, with the flex angle measured between a level ground plane and the longitudinal axis L at a rearward extent of the flexion region 32 when the heel region 22 is lifted and the sole structure 12 remains in contact with the ground plane. This range of flexion is greater than expected during walking while wearing the article of footwear 14. Accordingly, with the coupler 60 in the first position, the bending stiffness of the plate assembly 10 will remain at the relatively low level associated with the first position of the coupler 60 throughout the walking stride.

Figure 2:
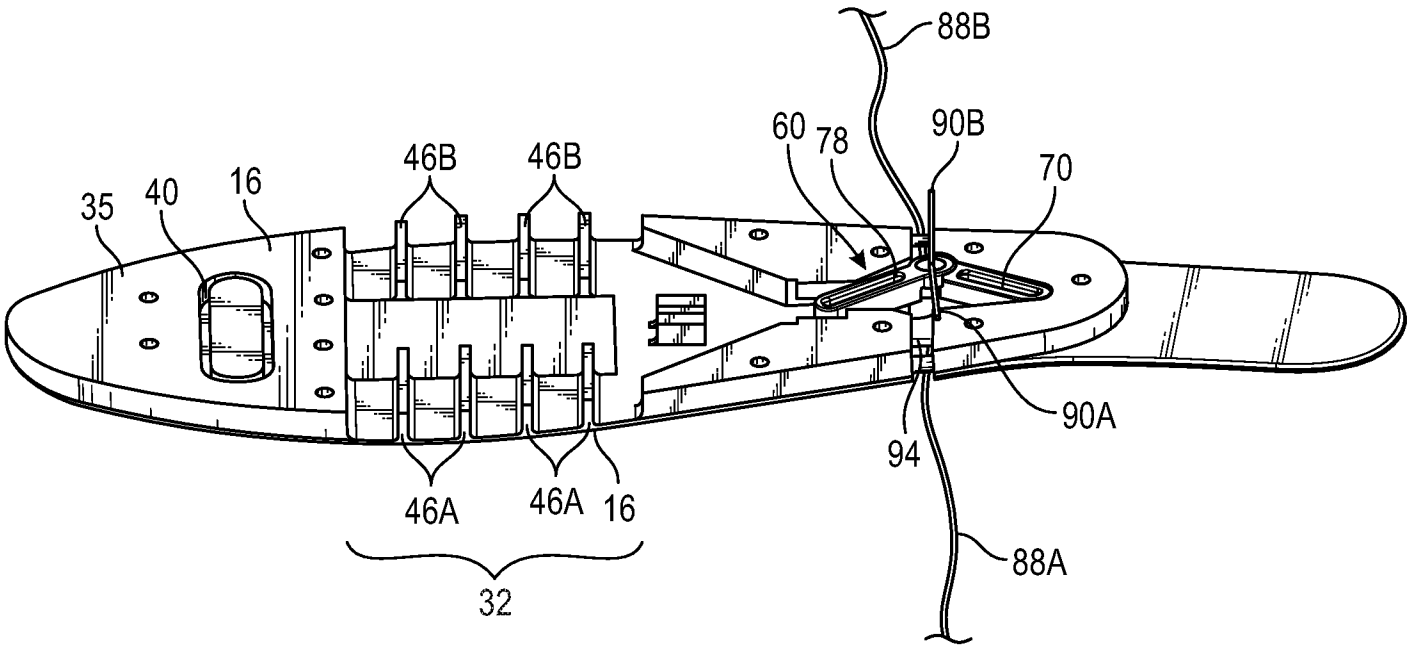
FIG. 2 is a perspective view of a first plate and a coupler included in the plate assembly of FIG. 1.

As shown in FIGS. 3, 16, and 17, a cable 88 is secured to the coupler 60 at the movable pivot 80. The cable 88 includes a medial portion 88A that extends laterally-outward from the movable pivot 80 beyond the medial edge 28 of the first plate 16, and a lateral portion 88B that extends laterally-outward from the movable pivot 80 beyond the lateral edge 30 of the first plate 16. Although the portions 88A, 88B are shown extending straight outward in FIG. 3, the cable 88 is flexible, as indicated in FIG. 2, and the portions 88A, 88B may be routed as desired, such as upward along an upper 90 of the article of footwear 14, as further described with respect to FIG. 12. In FIG. 17, the portions 88A, 88B are threaded through the stacked openings of the links 70, 78 at the movable pivot 80, and the respective ends 90A, 90B of the portions 88A, 88B are shown bent to indicate that the portions 88A, 88B are secured to the links 70, 78 at the movable pivot 80. The ends 90A, 90B may be knotted, tied together, or tied to the portions 88A, 88C to maintain the portions 88A, 88B of the cable 88 secured to the coupler 60 at the movable pivot 80. The cable 88 may be a single cable with the portions 88A, 88B part of a unitary loop extending within the upper 90, such as shown and described with respect to FIG. 12, or the portions 88A, 88B may be separate cables that extend upward along the respective medial and lateral sides of the upper 90 to be pulled separately to move the coupler 60.

The first link 70 and the second link 78 move transversely relative to the first plate 16 at the movable pivot 80 when the coupler 60 is selectively moved from the first position of FIG. 3 to the second position of FIG. 4. The free end 82 of the second link 78 is spaced apart from the second plate 18 when the coupler 60 is in the first position. For example, as shown in the bottom view of FIG. 5, the free end 82 is partially under the free portion 56 of the second plate 18, but the end surface 83 of the free end 82 of the link 78 (best shown in FIG. 17) is not in contact with the second plate 18. Accordingly, when the plate assembly 10 bends during dorsiflexion, the free portion 56 of the second plate 18 can travel in a longitudinal gap 92.

The coupler 60 is transversely movable from the first position of FIG. 3 to the second position of FIG. 4 by a laterally-outward force F1, indicated in FIG. 4, applied on the medial portion 88A of the cable 88. The coupler 60 is transversely movable from the second position to the first position by a laterally-outward force F2 on the lateral portion 88B of the cable 88. The cable 88 extends out of the bottom of the stacked links 70, 78, as shown in FIG. 17. The first plate 16 has openings through which the cable 88 extends downward from the movable pivot 80, and the cable 88 then extends laterally outward in channels 94 formed by the first plate 16 on the bottom of the first plate 16 as best shown in FIG. 7. This helps to restrain the cable 88 and guide its movement in the lateral direction during a switch between the first position and the second position of the coupler 60. Vertical walls 100, 102 of the first plate 16 limit transverse movement of the coupler 60 toward the lateral edge 30 and establish the first position of the coupler 60 when the coupler 60 abuts the walls 100, 102 as shown in FIG. 3. Vertical walls 104, 106 of the first plate 16 limit transverse movement of the coupler 60 toward the medial edge 28 and establish the second position of the coupler 60 shown in FIG. 4. A rounded wall between vertical walls 100, 102 receives the heads of the links 70, 78 at the movable pivot 80 in the first position. A rounded wall between vertical walls 104, 106 receives the heads of the links 70, 78 at the movable pivot 80 in the second position.

The angle A1 between the walls 100, 102 (shown in FIG. 4) is less than the angle A2 between the walls 104, 106 (shown in FIG. 3). Because the fixed end of the link 70 remains in one longitudinal position relative to the first plate 16 at all positions of the coupler 60, the free end 82 of the second link 78 will be moved forward in the slot 86 in the second position relative to the first position. The distal surface of the second plate 18 has a downward-extending protrusion 109 with a rear-opening notch 112 at the free portion 56. A plurality of buttresses 111 extend downward from the second plate 18, and extend forward from the protrusion 109 to support the free portion 56 and inhibit buckling of the free portion 56.

Figure 8C:
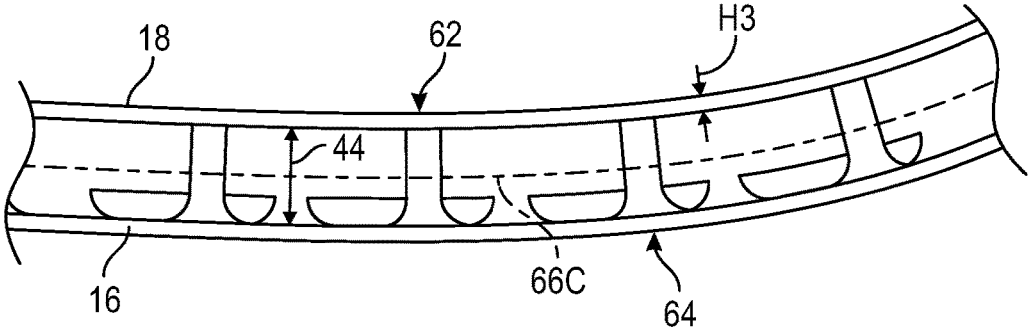
FIG. 8C is a fragmentary medial side view of the plate assembly of FIG. 1 representing dorsiflexion with the coupler in the second position.

The angle A2, the length of the links 70, 78 and the position of the notch 112 are selected so that the surface 83 of the free end 82 abuts the second plate 18 at a wall 114 of the notch 112 when the coupler 60 is in the second position. This abutment is referred to as the coupler 60 operatively engaging the second plate 18 because, when the plate assembly 10 bends longitudinally with the coupler 60 abutting the second plate 18, the second plate 18 cannot slide longitudinally relative to the first plate 16 and the plates 16, 18 are connected to bend as a single unit with a bending stiffness proportional to the inertia of the plate assembly 10 according to Equation 1 above, with the height h being the total height H3 of the plate assembly 10 from the proximal surface 62 of the second plate 18 to the distal surface 64 of the first plate 16, as shown in FIG. 8C. More specifically, the plate assembly 10 has a single neutral bending axis 66C. Because the second plate 18 is above the neutral bending axis, it is entirely in compression, while the first plate 16 below the neutral bending axis 66C is entirely in tension. The height H3 is significantly greater than the height H1 and the height H2, and the bending stiffness of the plate assembly 10 with the coupler 60 in the second position is likewise significantly greater than when the coupler 60 is in the first position.

As is apparent in FIGS. 3 and 4, the movable pivot 80 is transversely offset from both the fixed pivot 72 and the free end 82 of the second link 78 toward the lateral edge 30 when the coupler 60 is in the first position, and the movable pivot 80 is transversely offset from both the fixed pivot 72 and the free end 82 of the second link 78 toward the medial edge 28 of the first plate 16 when the coupler 60 is in the second position. Both the first position and the second position of the coupler 60 may be referred to as over-center positions, as the coupler 60 must pass through a straight state (in which the links 70, 78 are 180 degrees apart from one another (i.e., extend along a straight line) in transitioning from the first position to the second position or from the second position to the first position. The walls 104, 106 help to support the links 70, 78, acting as reaction surfaces for the links 70, 78 when the coupler 60 is in the second position, providing more stability to the coupler 60 than if the coupler 60 was subjected to compressive force in the straight position.

Although the fixed portion 34 is shown fixed forward of the flexion region 32, in an alternative embodiment, the second plate 18 can be configured so that a fixed portion is disposed rearward of the flexion region 32, and the free portion and the coupler 60 are disposed forward of the flexion region. As another alternative embodiment, the components of the plate assembly 10 can be configured so that the fixed pivot 72 of the coupler 60 could be secured to the second plate 18, and the free end 82 of the link 78 can be configured to operatively engage a wall of the first plate 16 when the coupler 60 is in the second position.

FIG. 10 shows the plate assembly 10 when assembled with other components of the sole structure 12. For example, the sole structure 12 includes a midsole 120 having a forefoot region 22, a midfoot region 24, and a heel region 26. The midsole 120 has an opening 122 extending from a proximal surface 124 of the midsole to a distal surface 126 of the midsole in the forefoot region 22. The midsole 120 extends over the plate assembly 10 in the heel region 26 and the midfoot region 24 such that it overlies the first plate 16 and the second plate 18. In the forefoot region 22, the first plate 16 and the second plate 18 extend in the opening 122. This avoids stacking the midsole 120 entirely above the plate assembly 10 in the forefoot region 22, preventing an excessive vertical height of the sole structure 12 in the forefoot region 22. Generally, sole structures are configured to have a lower overall height in the forefoot region 22 than in the heel region 26.

Figure 11:
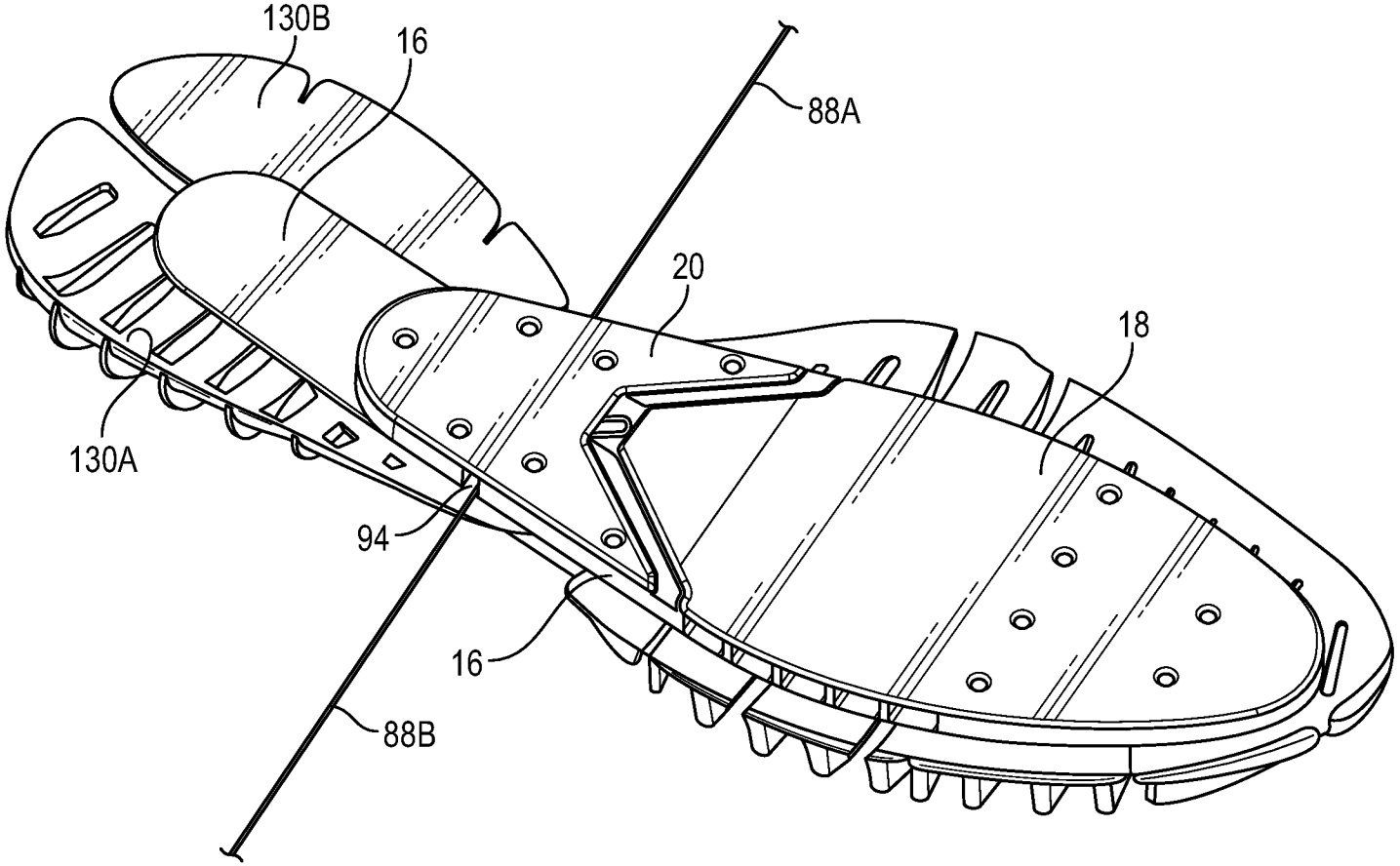
FIG. 11 is a lateral perspective view of the sole structure of FIG. 10 with the midsole removed.
Figure 15:
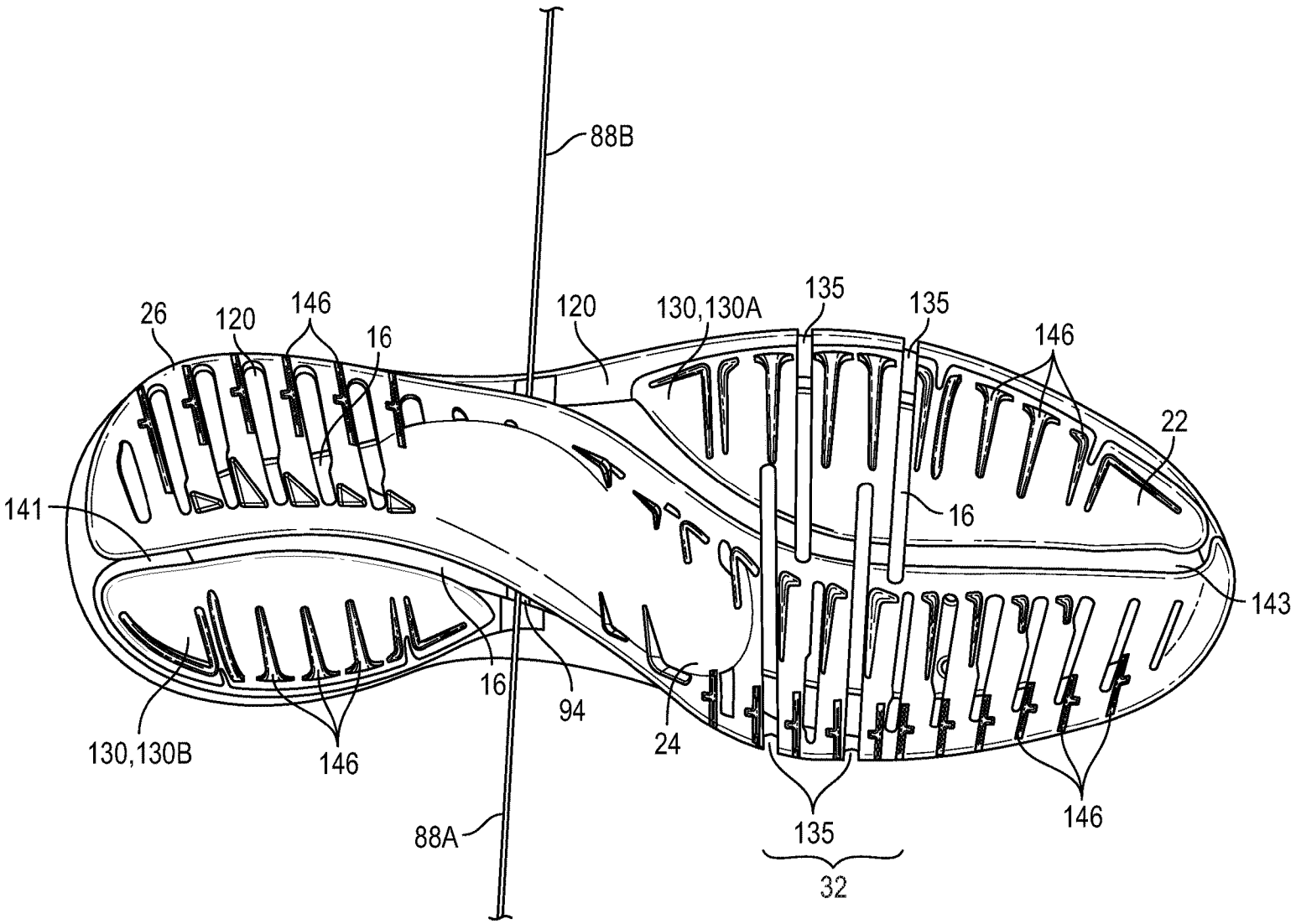
FIG. 15 is a bottom view of the sole structure of FIG. 10.

FIGS. 10, 11, and 15 show a multi-piece outsole 130 secured to the distal surface of the first plate 16 and to the bottom surface of the midsole 120. As best shown in FIG. 15, the outsole 130 includes a first portion 130A that extends in the forefoot region 22, the midfoot region 24, and the heel region 26, and a discrete second portion 130B that extends only in the heel region 26. In the forefoot region 22 and the midfoot region 24, the first portion 130A extends laterally-outward of the medial edge 28 and the lateral edge 30 of the first plate 16. Lateral cutouts 135 are provided at both the lateral side and the medial side of the first portion 130A in the flexion region 32, and extend from the respective side past the longitudinal axis L of the sole structure 12. The lateral cutouts 135 ensure that, during longitudinal bending, the outsole portion 130A does not significantly contribute to the bending stiffness of the sole structure 12 at the flexion region 32, so that the bending stiffness of the sole structure 12 is mainly dependent upon the plate assembly 10 in the flexion region 32. Similarly, the first portion 130A is separated from the second portion 130B by a gap 141 in the heel region 26. The gap 141 promotes torsional flexibility of the outsole 130. Fins 146 extend downward from the outsole 130 for increased traction and may aid in minimizing twisting of the article of footwear 14 during the backswing and downswing stages of a golf swing. The fins 146 are arranged on either side of a groove 143 in the forefoot and midfoot regions of the first portion 130A.

Figure 14:
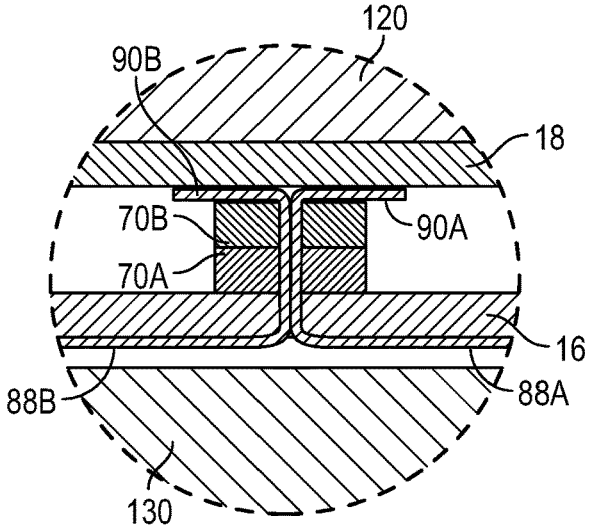
FIG. 14 is a fragmentary cross-sectional view of a portion of the article of footwear of FIG. 12 taken at lines 13-13 in FIG. 12.

As best indicated in FIGS. 10 and 15, the medial and lateral cable portions 88A, 88B extend laterally-outward from the sole structure 12 in the channels 94 shown in FIG. 7 between a distal surface of the first plate 16 and a proximal surface of the first portion 130A of the outsole 130. FIG. 14 also indicates the cable portion 88A, 88B extending below the first plate 16

Figure 13:
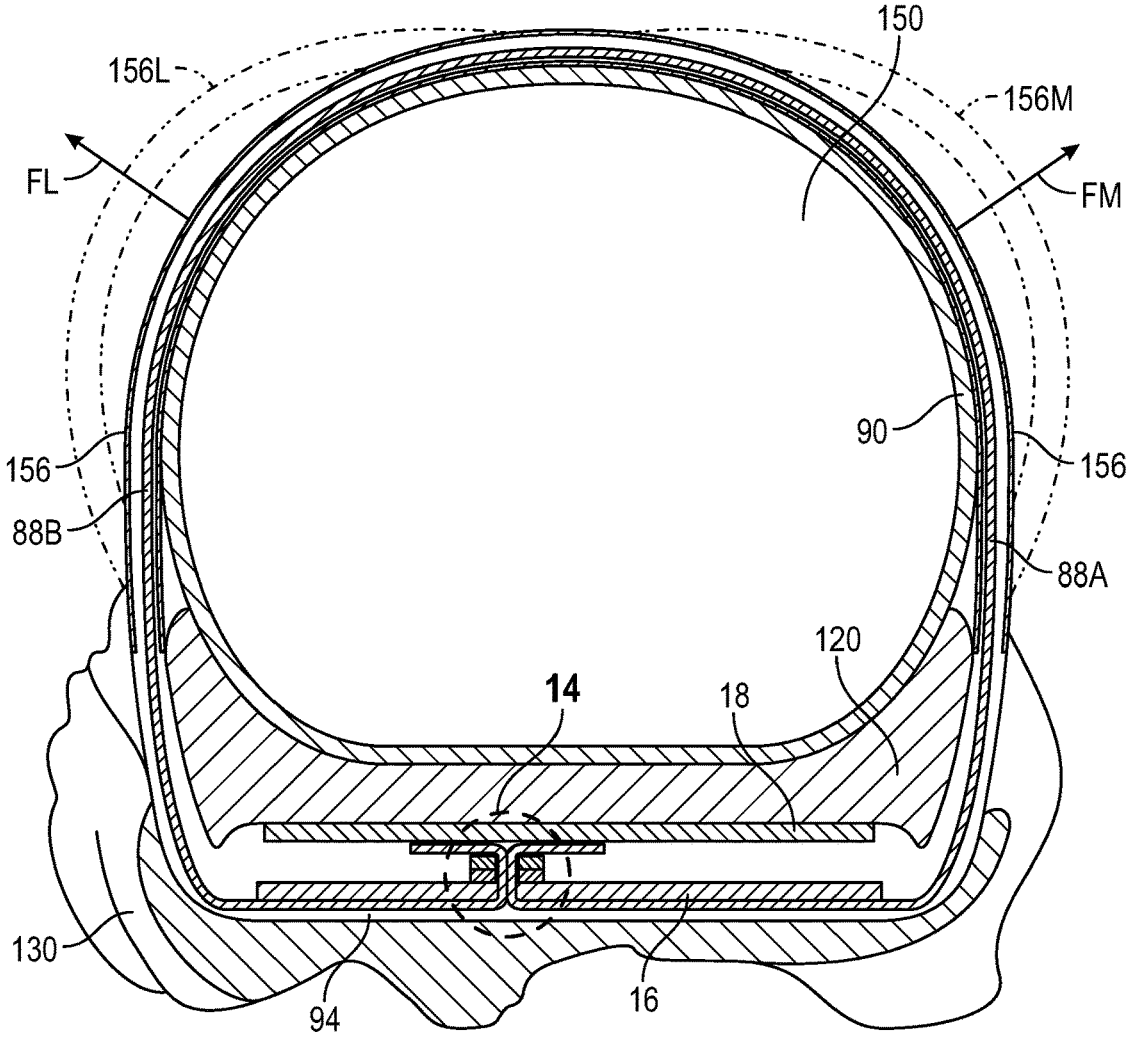
FIG. 13 is a cross-sectional view of the article of footwear of FIG. 12 taken at lines 13-13 in FIG. 12.

The cable 88 may be accessible to the wearer in various positions. In one example, the cable 88 is a unitary cable, as shown in FIGS. 12 and 13. For example, the article of footwear 14 includes an upper 90 secured to the midsole 120 to define a foot-receiving cavity 150 for receiving and supporting a wearer's foot on the sole structure 12. The medial portion 88A of the cable 88 extends along a medial side 152 of the upper 90, and the lateral portion 88B of the cable 88 extends along a lateral side 154 of the upper 90. An elastic sleeve 156 surrounds the medial portion 88A and the lateral portion 88B. The elastic sleeve 156 may be secured to a lower portion of the upper 90 by being positioned laterally inward of the midsole 120 as indicated in FIG. 12.

The elastic sleeve 156 may be liftable away from the exterior surface of the upper 90 by an outward force having a lateral component in order to tension either the medial portion 88A or the lateral portion 88B to switch the position of the coupler 60. For example, as shown in FIG. 13, a force FM may be applied by grabbing and lifting the elastic sleeve 156 to the position 156M at the medial side 152 of the upper 90. The force FM has a laterally-outward component that pulls the medial portion 88A of the cable 88 laterally outward, moving the coupler 60 from the first position to the second position, as described with respect to FIGS. 3 and 4. Similarly, a force FL applied by grabbing and lifting the elastic sleeve 156 at the lateral side 154 of the upper 90 to the position 156L has a laterally-outward component that pulls the lateral portion 88B of the cable 88 laterally outward, moving the coupler 60 from the second position to the first position, as described with respect to FIGS. 3 and 4. When not being pulled, the cable 88 can have some slack within the elastic sleeve 156.

In some embodiments, the medial portion 88A and the lateral portion 88B can be two separate cables. In such embodiments, the separate cables could be tied to one another in the sleeve 156. Alternatively, the separate cables could each be secured to the upper 90, such as by extending through separate eyelets of the upper, or by securing to other lacing or tensioning elements provided on the upper. The separate cables would function in the same manner as described to move the movable joint 80 of the coupler 60 transversely under a laterally-outward force at the cable on the medial side of the upper or on the cable at the lateral side of the upper.

FIGS. 18-22 show another embodiment of a plate assembly 210 that is part of a sole structure 214 (shown in FIG. 23) for an article of footwear. The plate assembly 210 includes a first plate 216, a second plate 218, and a third plate 220 that function in the same manner as described with respect to the first plate 16, the second plate 18, and the third plate 20 of the plate assembly 10. The plate assembly 210 has a flexion region 32, and a vertical gap 44 as described with respect to plate assembly 10. A longitudinal gap 292 exists between the second plate 218 and the third plate 220 and remains open over a range of flexion of the plate assembly 210.

Figure 19:
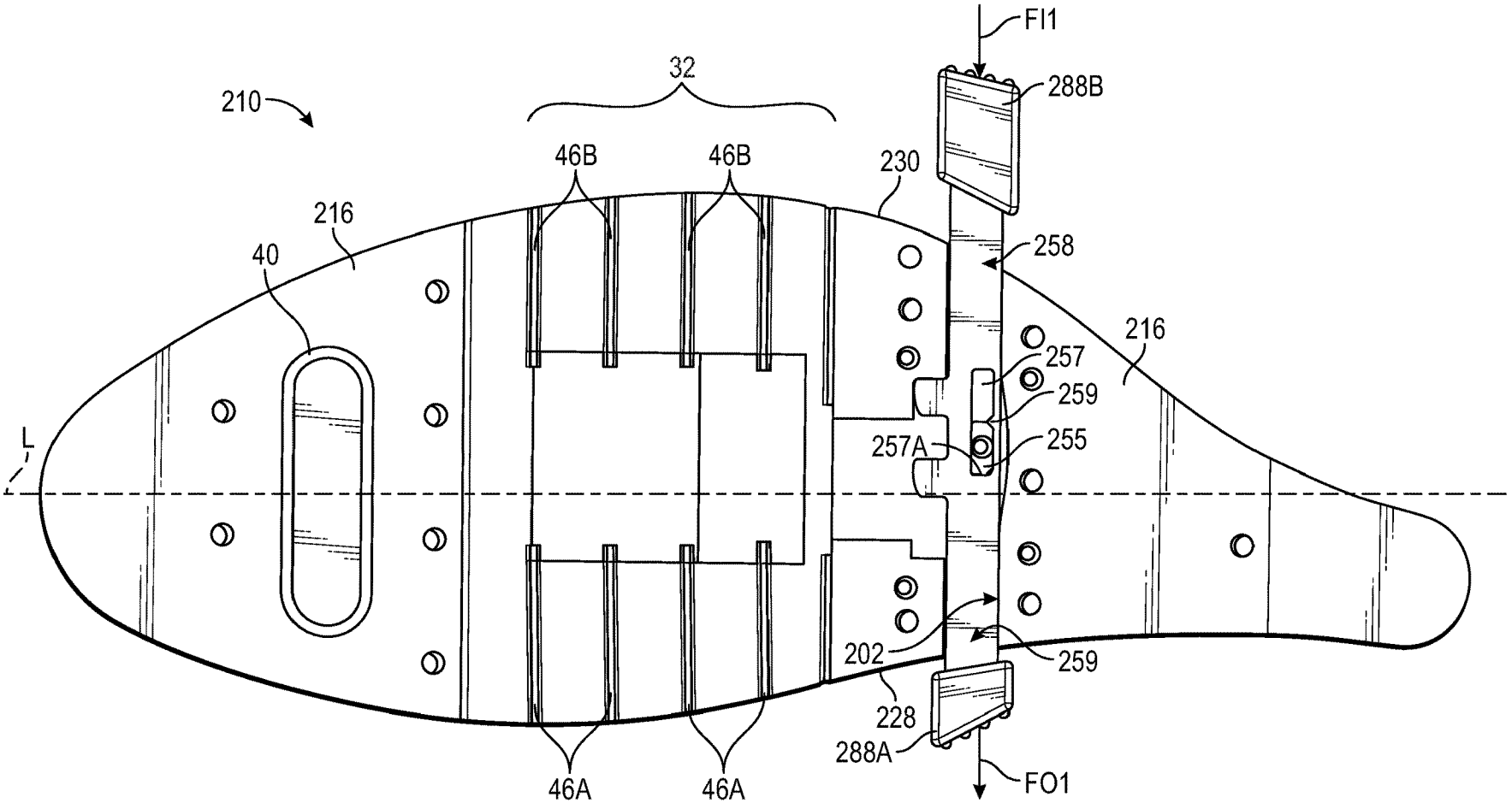
FIG. 19 is a plan view of a first plate and a coupler of the plate assembly of FIG. 18 with the coupler in a first position.
Figure 20:
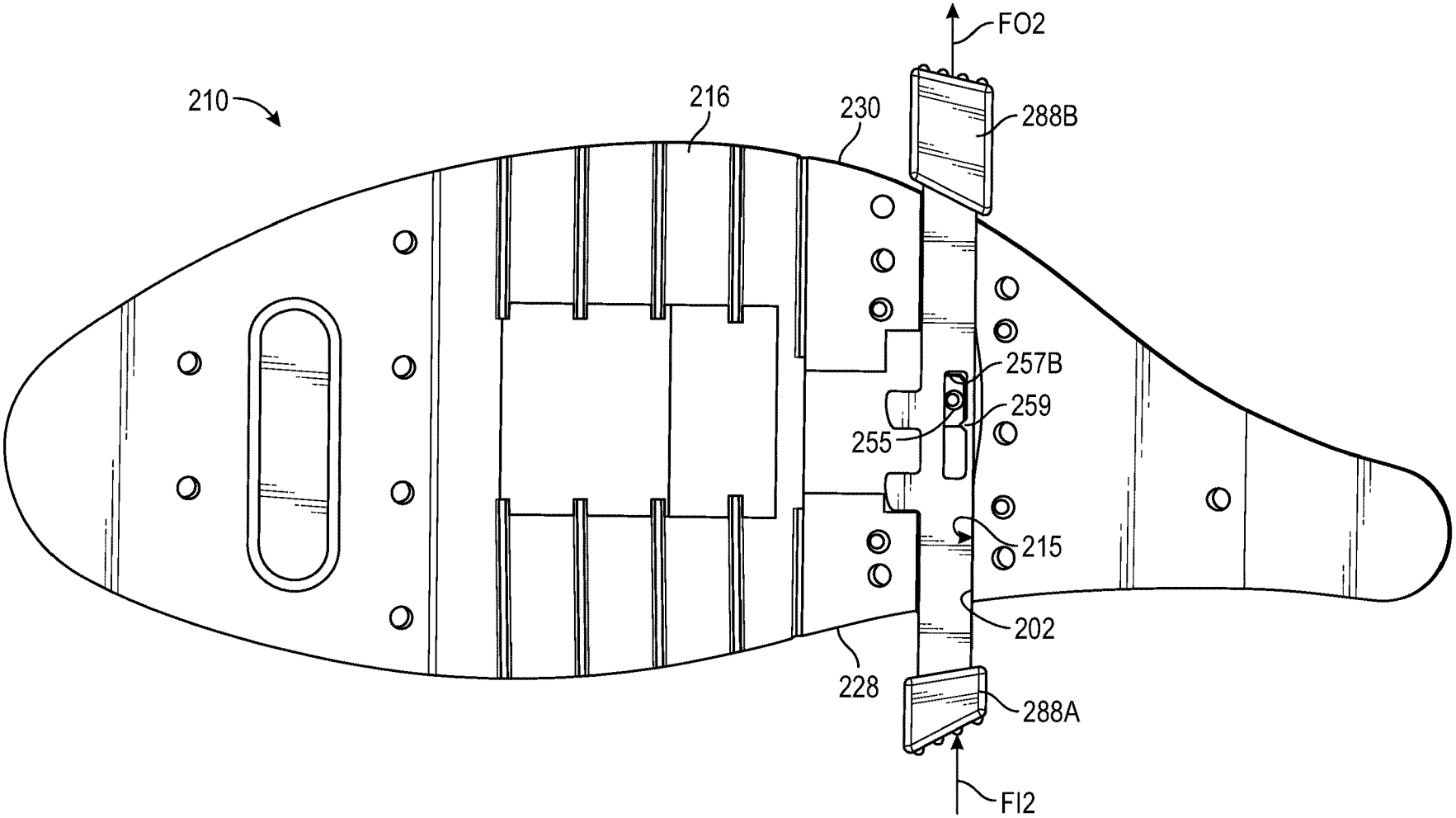
FIG. 20 is a plan view of the first plate and the coupler of the plate assembly of FIG. 18 with the coupler in a second position.

The plate assembly 210 includes a coupler 260 that is selectively movable transversely relative to the first plate 216 and the second plate 218 between a first position (shown in FIGS. 18 and 19) and a second position (shown in FIG. 20). The first position establishes a first, relatively low bending stiffness and the second position establishes a second, relatively high bending stiffness, respectively, of the plate assembly 210 under longitudinal bending in the flexion region 32. The coupler 260 has a medial end 288A that extends laterally-outward of the medial edge 228 of the first plate 216 in both the first position and the second position, and a lateral end 288B that extends laterally-outward of a lateral edge 230 of the first plate 216 in both the first position and the second position, as is apparent in FIGS. 19 and 20.

Figure 18:
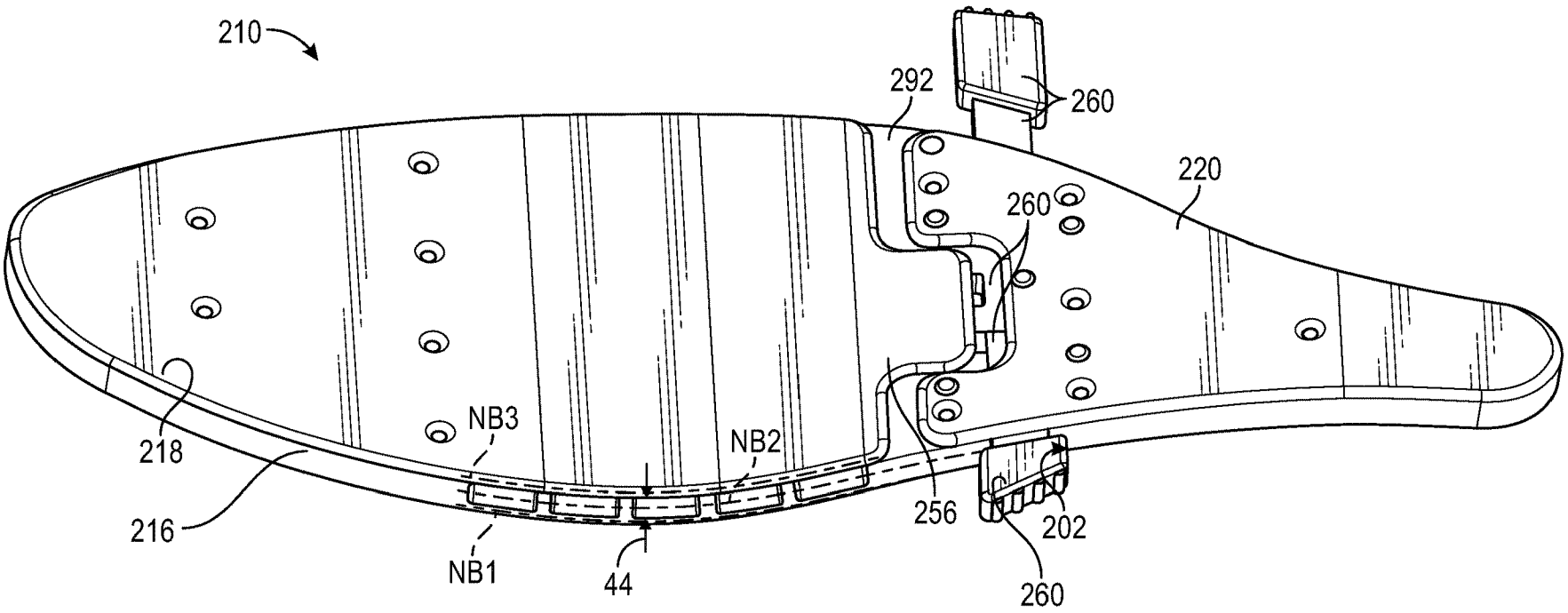
FIG. 18 is a schematic perspective view of a plate assembly of a sole structure of an article of footwear in an alternative aspect of the present teachings.

Similar to coupler 60, the coupler 260 is operatively connected to the first plate 216 as shown in FIG. 19, such that it is disposed adjacent a free portion 256 of the second plate 218, shown in FIG. 18. A post 255 extends upward from a proximal surface of the first plate 216. The coupler 260 has a slot 257 extending through the coupler 260 from a proximal surface 258 of the coupler 260 shown in FIG. 19 to a distal surface 261 of the coupler 260 shown in FIG. 21. The post 255 extends through the slot 257. Moreover, the third plate 220 is secured to the first plate 216 so that the coupler 260 is nested between the plates 216, 220.

The coupler 260 has a tab 259 extending into the slot 257 such that the slot is narrowed at the tab. The tab 259 helps to retain the coupler 260 in the selected position, and may provide tactile feedback as to when the position is achieved. The post 255 is between the first end 257A of the slot 257 and the tab 259 when the coupler 260 is in the first position of FIG. 19. The post 255 is between the second end 257B of the slot 257 and the tab 259 when the coupler 260 is in the second position of FIG. 20.

The coupler 260 is selectively movable transversely relative to the first plate 216 and the second plate 218 from the first position to the second position by applying a laterally inward force F11 on the end 288B, represented in FIG. 19. Alternatively or in addition, a laterally outward force F01 may be applied to the end 288A to move the coupler 260 from the first position to the second position. One or both of these forces may be applied manually. Alternatively, the laterally inward force F11 on the end 288B may be applied with the opposite foot of the wearer, for example.

To selectively move the coupler 260 from the second position to the first position, a laterally inward force FI2 may be applied on the end 288A, represented in FIG. 20. Alternatively or in addition, a laterally outward force F02 may be applied to the end 288B to move the coupler 260 from the first position to the second position. One or both of these forces may be applied manually. Alternatively, the laterally inward force on the end 288A may be applied with the opposite foot of the wearer, for example.

Figure 21:
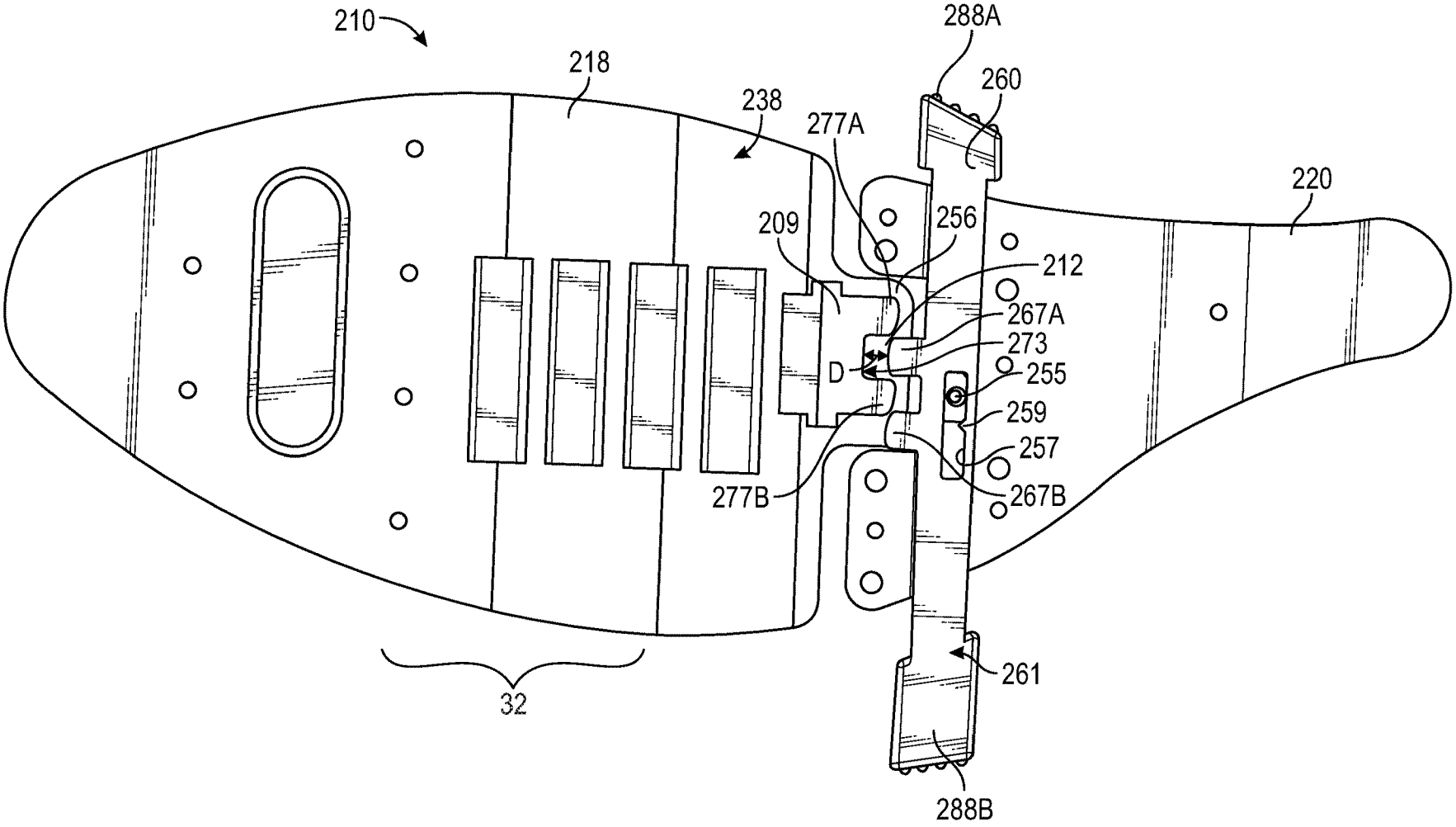
FIG. 21 is a bottom view of a second plate, the coupler, and a third plate of the plate assembly of FIG. 18 with the coupler in the first position.

As shown in FIG. 21, the coupler 260 is spaced apart longitudinally from the second plate 218 when the coupler 260 is in the first position such that the second plate 218 bends separately from the first plate 216 during longitudinal bending of the sole structure 212 at the flexion region 32 over a flexion range, such as a flexion range of 0 to 45 degrees. The coupler 260 has a first set of teeth 267A, 267B that extend longitudinally toward the second plate 218. Each of the teeth 267A, 267B may be referred to as a protrusion. The second plate 218 has a second set of teeth 277A, 277B extending longitudinally toward the coupler 260. Each of the teeth 277A, 277B may be referred to as a protrusion. The teeth 277A, 277B are part of a downward protrusion 209 at a distal surface 238 of the free portion 256.

The teeth 267A, 267B of the coupler 260 are transversely offset from and spaced apart from the teeth 277A, 277B of the second plate 218 when the coupler 260 is in the first position, as shown in FIG. 21. With the sets of teeth 267A, 267B and 277A, 277B offset from one another in this manner, the free end 256 of the second plate 218 is not subjected to compressive forces by the first plate 216, as the teeth 267A, 267B can move forward between teeth 277A, 277B at least over the distance D between the wall 273 of the protrusion 209 and the forward end of the tooth 267A.

Figure 22:
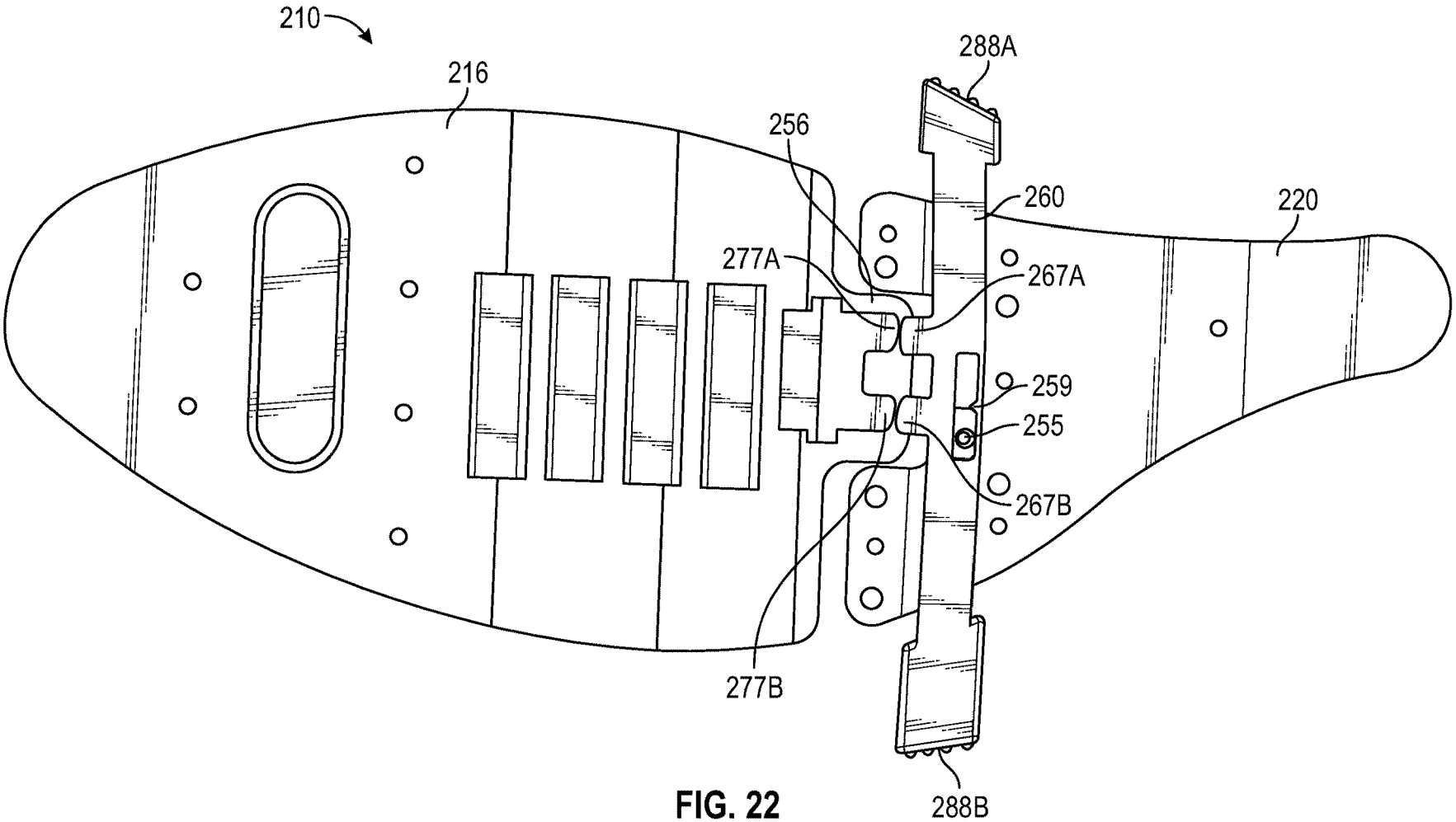
FIG. 22 is a bottom view of the second plate, the coupler, and the third plate of the plate assembly of FIG. 18 with the coupler in the second position.

The teeth 267A, 267B are at least partially aligned with and abut the teeth 277A, 277B when the coupler 260 is in the second position, as shown in FIG. 22. With the teeth 277A, 277B abutting teeth 267A, 267B, the coupler 260 is operatively engaged with the second plate 218. Referring to FIG. 20, the first plate 216 has a wall 202 with a vertically-extending surface 215 disposed at a rear end of the coupler 260. During longitudinal bending of the plate assembly 210, the coupler 260 abuts both the surface 215 of the wall 202 of the first plate 216, and the teeth 277A, 277B of the second plate 218. The second plate 218 is thus fixed longitudinally relative to the first plate 216 in the flexion region 32, and the second plate 218 bends only in compression while the first plate bends only in tension with a single neutral bending axis in a vertical position between the plates 216, 218 during longitudinal bending of the sole structure 212 at the flexion region 32 over a flexion range.

When the coupler 260 is in the first position, the free end 256 of the second plate 218 is not engaged by the coupler 260, and each of the first plate 216 and the second plate 218 has a separate neutral bending axis NB1, NB2, respectively. The portion of the first plate 216 above the neutral bending axis NB1 of the first plate is in compression, and the portion of the first plate 216 below the neutral bending axis NB1 is in tension. Likewise, the portion of the second plate 218 above the neutral bending axis NB2 is in compression, and the portion of the second plate 218 below the neutral bending axis NB2 is in tension.

When the coupler 260 is in the second position, a single neutral bending axis NB3 of the plate assembly 210 extends at a position between the first plate 216 and the second plate 218, similar to the neutral bending axis 66C of FIG. 8C. The first plate 216 is in tension, and the second plate 218 is in compression. An increase in bending stiffness of the plate assembly 210 relative to the bending stiffness when the coupler 260 is in the first position is associated with this position of a single neutral bending axis.

Figure 23:
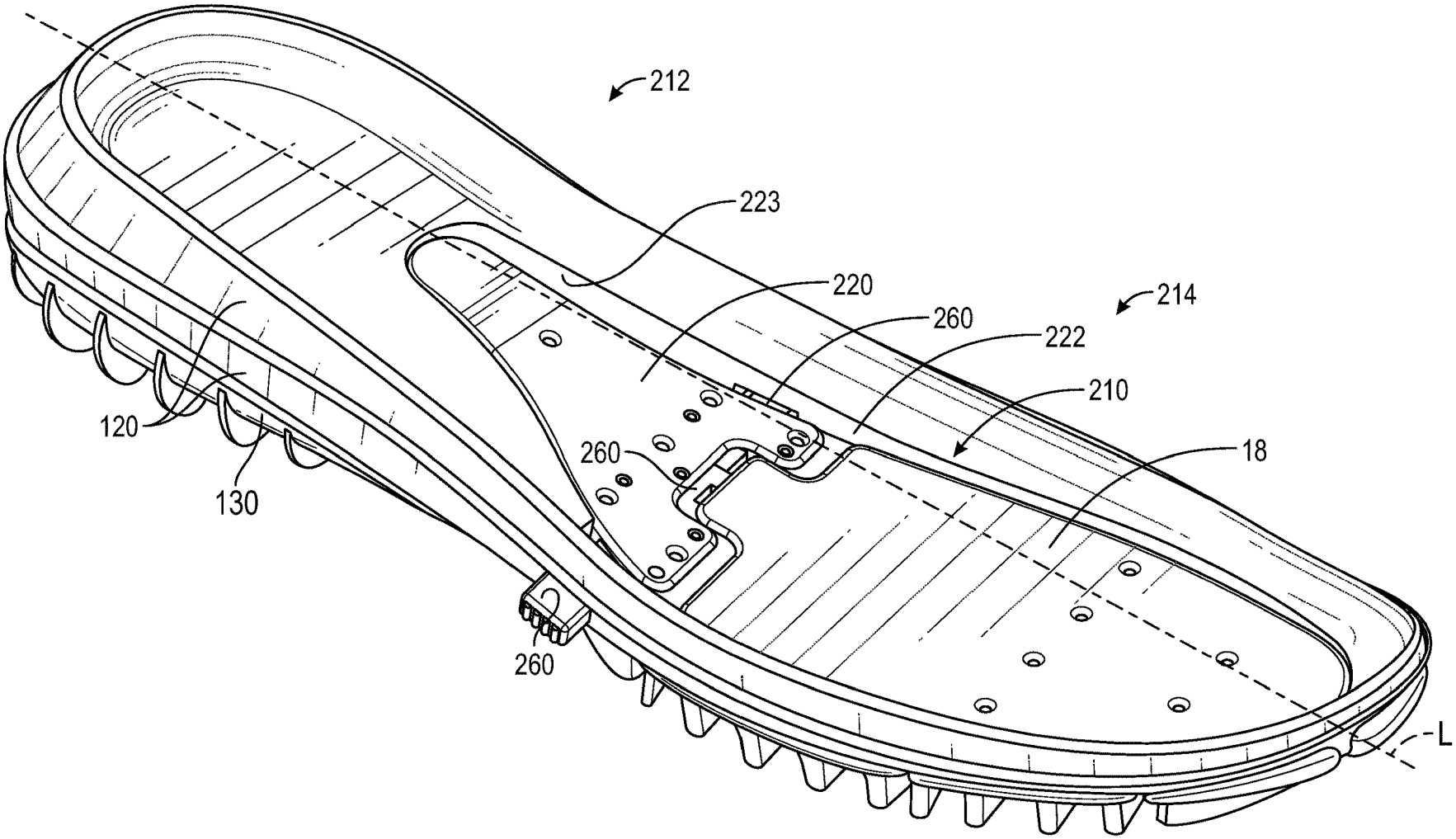
FIG. 23 is a lateral perspective view of a sole structure including a midsole, an outsole, and the plate assembly of FIG. 18.
Figure 24:
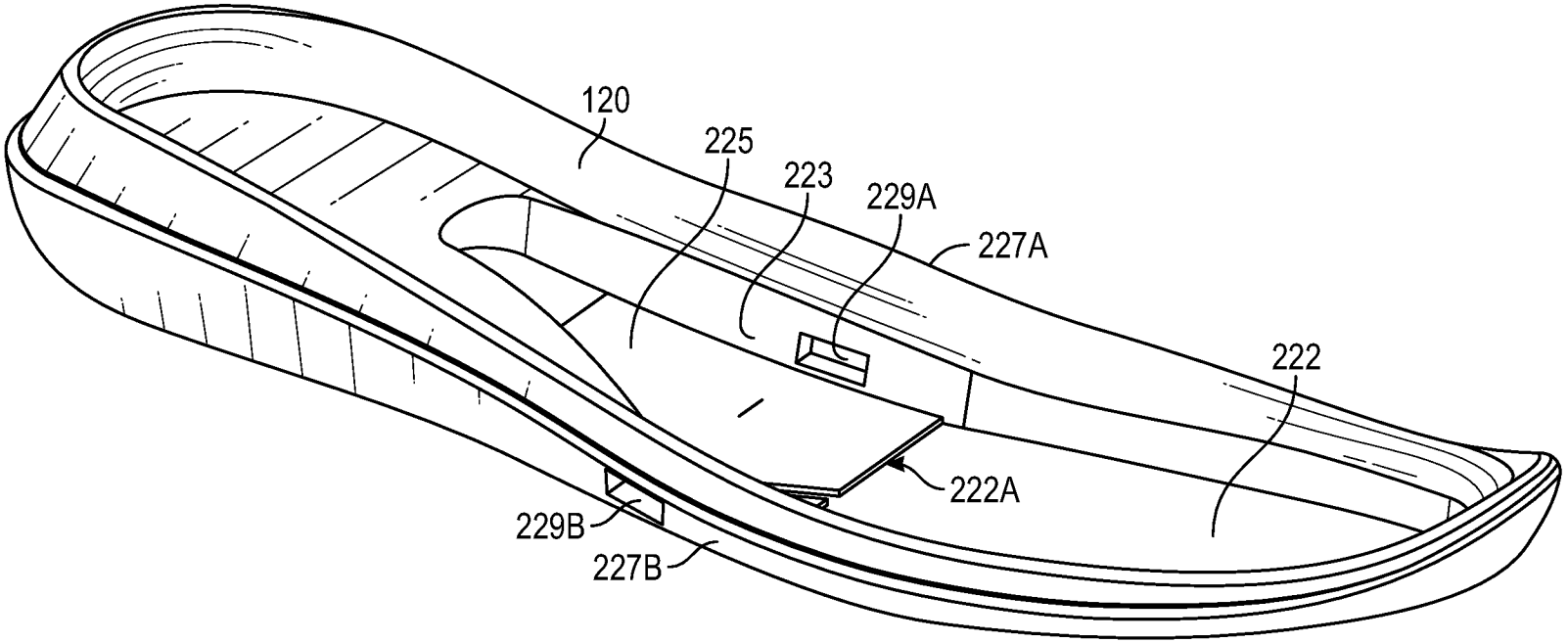
FIG. 24 is a lateral perspective view of the midsole of FIG. 23.

FIG. 23 shows the sole structure 212 with the plate assembly 210 assembled with the midsole 120 and the outsole 130 described with respect to FIG. 10. The midsole 120 at least partially surrounds the plate assembly 210. The midsole 120 has an opening 222 from its proximal surface to its distal surface even larger than opening 122 of FIG. 10, and each of the first plate 216 and the second plate 218 extend in the opening 222. As best shown in FIG. 24, a rear extent 222A of the opening 222 is forward of the coupler 260, so that the midsole 120 has a recess 223, rather than a through-hole, rearward of the rear extent 222A, with the third plate 220 in the recess 223 and a portion 225 of the midsole 120 underlying and supporting the third plate 220.

The midsole 120 has a medial side wall 227A with a medial opening 229A, and a lateral side wall 227B with a lateral opening 229B. The openings 229A, 229B are configured to be of a sufficient size and the coupler 260 is configured to be of a sufficient length so that the coupler 260 extends through both of the medial opening 229A and the lateral opening 229B in both the first position and the second position of the coupler 260.

Figure 25:
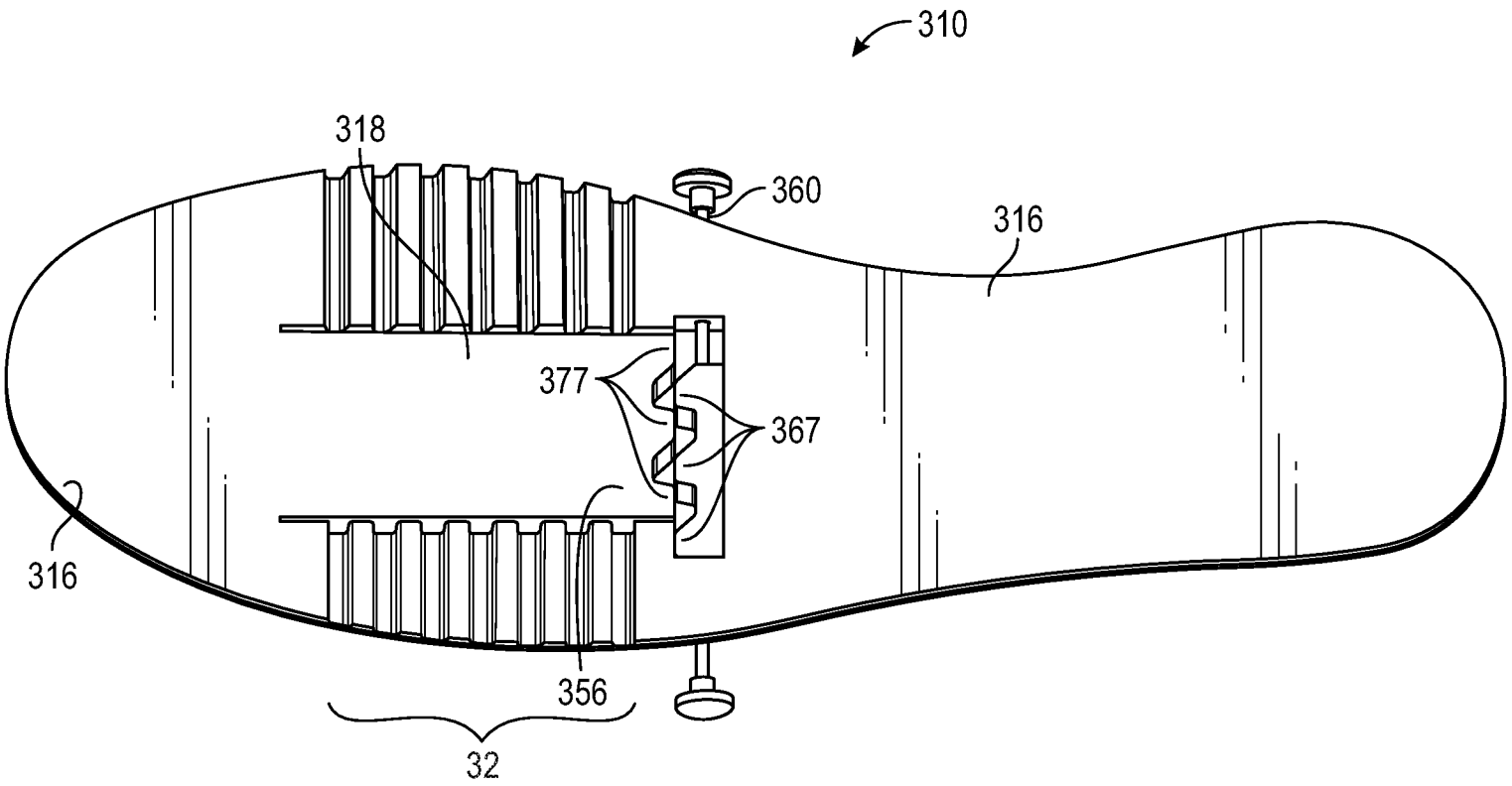
FIG. 25 is a plan view of a plate assembly of a sole structure of an article of footwear with a coupler in a first position in an alternative aspect of the present teachings.
Figure 26:
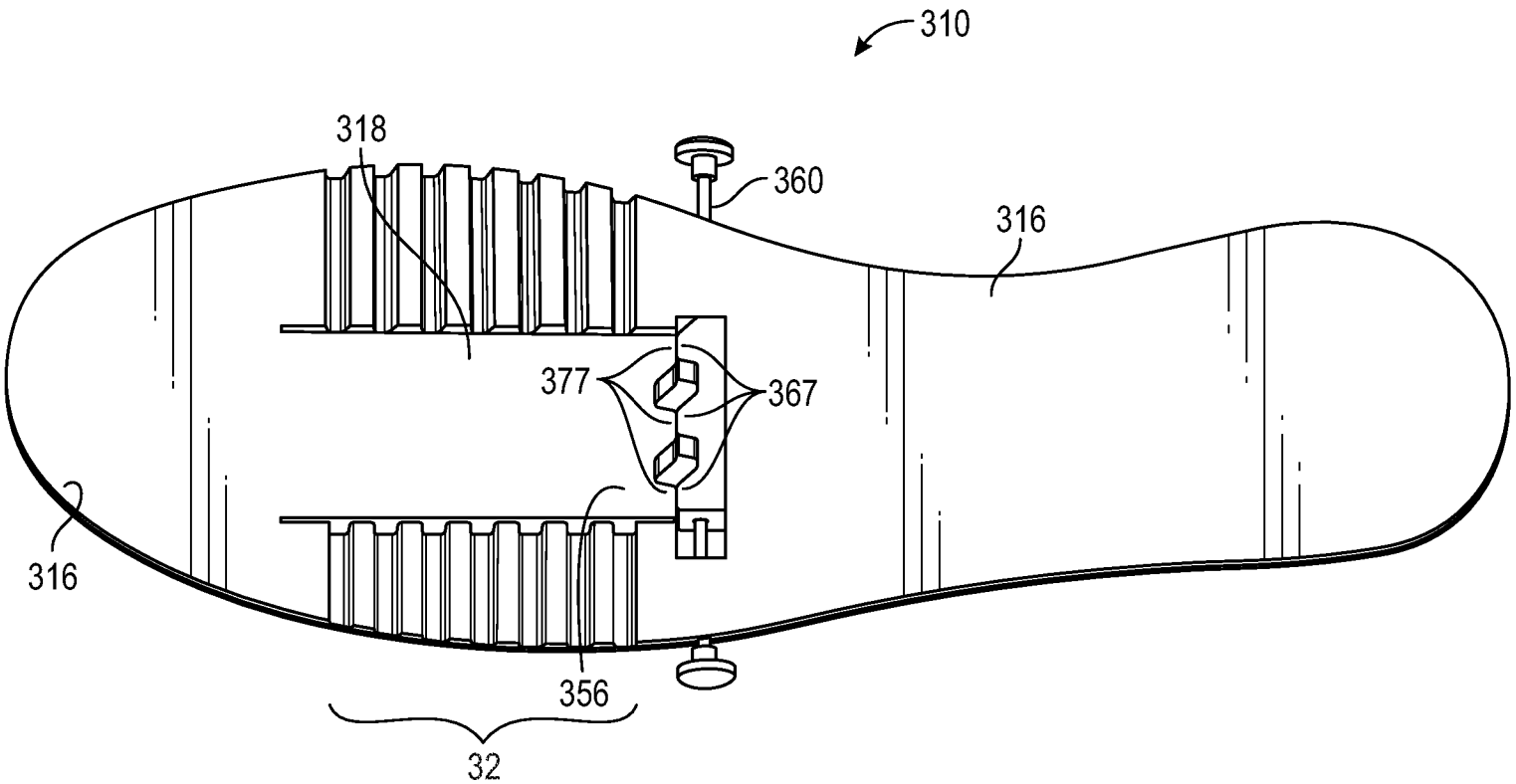
FIG. 26 is a plan view of the plate assembly of FIG. 25 with the coupler in a second position.
Figure 27:
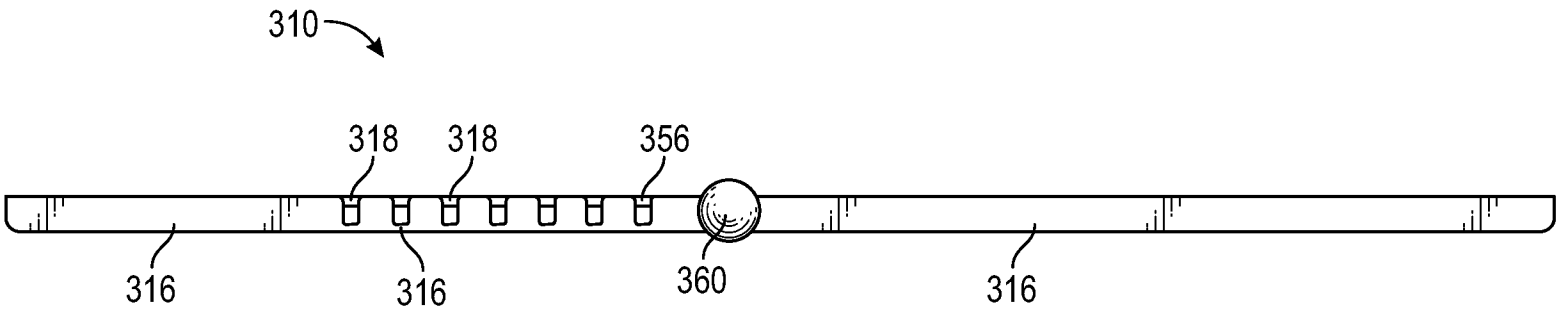
FIG. 27 is a lateral side view of the plate assembly of FIG. 25.

FIGS. 25-27 show another embodiment of a plate assembly 310 in which portions indicated as a first plate 316 and a second plate 318 are part of a unitary, one-piece component. A coupler 360 includes a first set of longitudinally extending teeth 367 that extend toward a second set of longitudinally extending teeth disposed on a free portion 356 of the second plate 318. The coupler 360 can be selectively moved between a first position, shown in FIG. 25, and a second position shown in FIG. 26, similar to the coupler 260 of FIGS. 21 and 22. In the first position of the coupler 360, the teeth 367 are transversely offset from the teeth 377 and the second plate 318 bends separately from the first plate, each plate 316, 318 having a separate neutral bending axis, a portion in compression, and apportion in tension. In the second position of the coupler 360, the teeth 367 are at least partially aligned with and abut the teeth 377 so that the coupler 360 is engaged with the second plate 318, and the first plate and second plate bend as a unit, with a single neutral bending axis between the first plate and the second plate, the first plate 216 bending in tension and the second plate 218 bending in compression when the plate assembly 310 bends along its longitudinal axis L in the flexion region 32.

The following Clauses provide example configurations of a sole structure for an article of footwear disclosed herein.

Clause 1: A sole structure for an article of footwear comprising: a first plate and a second plate both extending longitudinally in a flexion region of the sole structure with the second plate disposed above the first plate in the flexion region; wherein the second plate has a fixed portion fixed to the first plate, and has a free portion; a coupler operatively connected to one of the first plate and the free portion of the second plate; wherein the coupler is selectably movable transversely relative to the first plate and the second plate between a first position and a second position; wherein the coupler is spaced apart from the other one of the first plate and the free portion of the second plate when the coupler is in the first position; and wherein the coupler operatively engages the other one of the first plate and the free portion of the second plate when the coupler is in the second position.

Clause 2: The sole structure of Clause 1, wherein: when the coupler is in the first position, the first plate has a portion in tension and a portion in compression during longitudinal bending of the sole structure at the flexion region; and when the coupler is in the second position, the first plate is in tension and the second plate is in compression during longitudinal bending of the sole structure at the flexion region.

Clause 3: The sole structure of Clause 1 or Clause 2, wherein the second plate is spaced apart from the first plate by a vertical gap in the flexion region; and the sole structure further comprising stanchions extending from at least one of the first plate and the second plate across the vertical gap.

Clause 4: The sole structure of Clause 3, wherein the stanchions include: a medial set of stanchions extending adjacent a medial edge of said one of the first plate and the second plate; a lateral set of stanchions adjacent a lateral edge of said one of the first plate and the second plate; and a central set of stanchions disposed between the medial set and the lateral set and extending from the other one of the first plate and the second plate than the medial set and the lateral set.

Clause 5: The sole structure of Clause 4, wherein: each stanchion of the medial set and each stanchion of the lateral set has a groove at an inward side of the stanchion; each stanchion of the central set has a medial lip at the medial side of the stanchion and a lateral lip at the lateral side of the stanchion; and the medial lip interfits with the groove of the medial set and the lateral lip interfits with the groove of the lateral set.

Clause 6: The sole structure of any of Clauses 1-5, wherein: at the fixed portion of the second plate, a distal surface of the second plate has one of a protrusion and a recess; and a proximal surface of the first plate has the other one of the protrusion and the recess; and the protrusion fits into the recess.

Clause 7: The sole structure of Clause 6, wherein the recess is an annular groove.

Clause 8: The sole structure of any of Clauses 1-7, further comprising: a third plate fixed to the first plate on the same side of the first plate as the second plate; wherein the third plate is spaced longitudinally apart from the second plate by a longitudinal gap; and wherein the coupler is at least partially nested between the first plate and the third plate.

Clause 9: The sole structure of any of Clauses 1-8, further comprising: a midsole having a forefoot region, a midfoot region, and a heel region; wherein the midsole overlies the first plate and the second plate; wherein the midsole has an opening extending from a proximal surface of the midsole to a distal surface of the midsole in the forefoot region; and wherein the first plate and the second plate extend in the opening.

Clause 10: The sole structure of any of Clauses 1-9, wherein: the coupler is fixed to the first plate; the second plate has a protrusion with a wall at least partially facing the coupler; and the coupler abuts the wall when the coupler is in the second position.

Clause 11: The sole structure of any of Clauses 1-10, wherein: the coupler includes a first link and a second link; the first link is pivotably connected to the first plate at a fixed pivot; the second link is pivotably connected to the first link at a movable pivot; the second link has a free end, and the movable pivot is disposed between the fixed pivot and the free end of the second link; the first link and the second link move transversely relative to the first plate at the movable pivot when the coupler moves from the first position to the second position; and the free end of the second link is spaced apart from the free portion of the second plate when the coupler is in the first position, and operatively engages the second plate when the coupler is in the second position.

Clause 12: The sole structure of Clause 11, further comprising: at least one cable secured to the coupler at the movable pivot; wherein a medial portion of the at least one cable extends laterally-outward from the movable pivot beyond a medial edge of the first plate, and a lateral portion of the at least one cable extends laterally-outward from the movable pivot beyond a lateral edge of the first plate; wherein the coupler is transversely movable from the first position to the second position by a laterally-outward force on one of the medial portion and the lateral portion of the at least one cable; and wherein the coupler is transversely movable from the second position to the first position by a laterally-outward force on the other of the medial portion and the lateral portion of the at least one cable.

Clause 13: The sole structure of Clause 12, wherein: the movable pivot is transversely offset from both the fixed pivot and the free end of the second link toward one of the lateral edge and the medial edge of the first plate when the coupler is in the first position; and the movable pivot is transversely offset from both the fixed pivot and the free end of the second link toward the other one of the lateral edge and the medial edge of the first plate when the coupler is in the second position.

Clause 14: The sole structure of any of Clauses 12-13, in combination with an upper secured to the sole structure; and wherein the medial portion of the at least one cable extends along a medial side of the upper, and the lateral portion of the at least one cable extends along a lateral side of the upper.

Clause 15: The sole structure of any of Clauses 12-14, further comprising: a sleeve surrounding either or both of the medial portion and the lateral portion of the at least one cable.

Clause 16: The sole structure of Clause 1, wherein the coupler has a medial end extending laterally-outward of a medial edge of the first plate in both the first position and the second position, and a lateral end extending laterally-outward of a lateral edge of the first plate in both the first position and the second position.

Clause 17: The sole structure of Clause 16, wherein: the coupler has a protrusion extending toward the other one of the first plate and the second plate; the other one of the first plate and the second plate has a protrusion extending toward the coupler; the protrusion of the coupler is transversely offset from and spaced apart from the protrusion of the other one of the first plate and the second plate when the coupler is in the first position; and the protrusion of the coupler is at least partially aligned with and abuts the protrusion of the other one of the first plate and the second plate when the coupler is in the second position.

Clause 18: The sole structure of Clause 17, wherein: the coupler has a first set of teeth extending longitudinally toward the other one of the first plate and the second plate; the other one of the first plate and the second plate has a second set of teeth extending longitudinally toward the coupler; the teeth of the first set are transversely offset from and spaced apart from the teeth of the second set when the coupler is in the first position; and the teeth of the first set of teeth are at least partially aligned with and abut the teeth of the second set when the coupler is in the second position.

Clause 19: The sole structure of Clause 18, further comprising: a post extending from the one of the first plate and the second plate; wherein: the coupler has a slot extending through the coupler from a proximal surface of the coupler to a distal surface of the coupler; the post extends through the slot of the coupler; the post is at a first end of the slot when the coupler is in the first position; and the post is at a second end of the slot opposite the first end when the coupler is in the second position.

Clause 20: The sole structure of Clause 19, wherein: the coupler has a tab extending into the slot such that the slot is narrowed at the tab; the post is between the first end of the slot and the tab when the coupler is in the first position; and the post is between the second end of the slot and the tab when the coupler is in the second position.

Clause 21: The sole structure of any of Clauses 16-20, further comprising: a midsole at least partially surrounding the first plate and the second plate; wherein the midsole has a medial side wall with a medial opening; wherein the midsole has a lateral side wall with a lateral opening; and wherein the coupler extends through both of the medial opening and the lateral opening in both the first position and the second position.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear" or "footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A sole structure for an article of footwear comprising:

a first plate and a second plate both extending longitudinally in a flexion region of the sole structure with the second plate disposed above the first plate in the flexion region;

wherein the second plate has a fixed portion fixed to the first plate, and has a free portion;

a coupler operatively connected to one of the first plate and the free portion of the second plate;

wherein the coupler is selectably movable transversely relative to the first plate and the second plate between a first position and a second position;

wherein the coupler is spaced apart from one of the first plate and the free portion of the second plate when the coupler is in the first position;

wherein the coupler operatively engages the other of the first plate and the free portion of the second plate when the coupler is in the second position; and wherein:

when the coupler is in the first position, the first plate has a portion in tension and a portion in compression during longitudinal bending of the sole structure at the flexion region; and when the coupler is in the second position, the first plate is in tension and the second plate is in compression during longitudinal bending of the sole structure at the flexion region.

2. The sole structure of claim 1, wherein the second plate is spaced apart from the first plate by a vertical gap in the flexion region; and the sole structure further comprising stanchions extending from at least one of the first plate and the second plate across the vertical gap.

3. The sole structure of claim 2, wherein the stanchions include:

a medial set of stanchions extending adjacent a medial edge of said one of the first plate and the second plate;

a lateral set of stanchions adjacent a lateral edge of said one of the first plate and the second plate; and a central set of stanchions disposed between the medial set and the lateral set and extending from the other of the first plate and the second plate than the medial set and the lateral set.

4. The sole structure of claim 3, wherein:

each stanchion of the medial set and each stanchion of the lateral set has a groove at an inward side of the stanchion;

each stanchion of the central set has a medial lip at a medial side of the stanchion and a lateral lip at a lateral side of the stanchion; and the medial lip interfits with the groove of the medial set and the lateral lip interfits with the groove of the lateral set.

5. The sole structure of claim 1, wherein:

at the fixed portion of the second plate, a distal surface of the second plate has one of a protrusion and a recess; and a proximal surface of the first plate has the other of the protrusion and the recess; and the protrusion fits into the recess.

6. The sole structure of claim 5, wherein the recess is an annular groove.

7. The sole structure of claim 1, further comprising:

a third plate fixed to the first plate on the same side of the first plate as the second plate;

wherein the third plate is spaced longitudinally apart from the second plate by a longitudinal gap; and wherein the coupler is at least partially nested between the first plate and the third plate.

8. The sole structure of claim 1, further comprising:

a midsole having a forefoot region, a midfoot region, and a heel region;

wherein the midsole overlies the first plate and the second plate;

wherein the midsole has an opening extending from a proximal surface of the midsole to a distal surface of the midsole in the forefoot region; and wherein the first plate and the second plate extend in the opening.

9. The sole structure of claim 1, wherein:

the coupler is fixed to the first plate;

the second plate has a protrusion with a wall at least partially facing the coupler; and the coupler abuts the wall when the coupler is in the second position.

10. The sole structure of claim 1, wherein:

the coupler includes a first link and a second link;

the first link is pivotably connected to the first plate at a fixed pivot;

the second link is pivotably connected to the first link at a movable pivot;

the second link has a free end, and the movable pivot is disposed between the fixed pivot and the free end of the second link;

the first link and the second link move transversely relative to the first plate at the movable pivot when the coupler moves from the first position to the second position; and the free end of the second link is spaced apart from the free portion of the second plate when the coupler is in the first position, and operatively engages the second plate when the coupler is in the second position.

11. The sole structure of claim 10, further comprising:

at least one cable secured to the coupler at the movable pivot;

wherein a medial portion of the at least one cable extends laterally-outward from the movable pivot beyond a medial edge of the first plate, and a lateral portion of the at least one cable extends laterally-outward from the movable pivot beyond a lateral edge of the first plate;

wherein the coupler is transversely movable from the first position to the second position by a laterally-outward force on one of the medial portion and the lateral portion of the at least one cable; and wherein the coupler is transversely movable from the second position to the first position by a laterally-outward force on the other of the medial portion and the lateral portion of the at least one cable.

12. The sole structure of claim 11, wherein:

the movable pivot is transversely offset from both the fixed pivot and the free end of the second link toward one of the lateral edge and the medial edge of the first plate when the coupler is in the first position; and the movable pivot is transversely offset from both the fixed pivot and the free end of the second link toward the other of the lateral edge and the medial edge of the first plate when the coupler is in the second position.

13. The sole structure of claim 11, in combination with an upper secured to the sole structure; and wherein the medial portion of the at least one cable extends along a medial side of the upper, and the lateral portion of the at least one cable extends along a lateral side of the upper.

14. The sole structure of claim 11, further comprising:

a sleeve surrounding either or both of the medial portion and the lateral portion of the at least one cable.

* * * * *